US011104130B2

(12) United States Patent
Togashi

(10) Patent No.: US 11,104,130 B2
(45) Date of Patent: Aug. 31, 2021

(54) FLOW-PATH MEMBER, LIQUID EJECTING HEAD AND LIQUID EJECTING APPARATUS

(71) Applicant: SEIKO EPSON CORPORATION, Tokyo (JP)

(72) Inventor: Isamu Togashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/919,575

(22) Filed: Jul. 2, 2020

(65) Prior Publication Data

US 2020/0331265 A1 Oct. 22, 2020

Related U.S. Application Data

(63) Continuation of application No. 16/356,754, filed on Mar. 18, 2019, now Pat. No. 10,730,295, which is a continuation of application No. 15/845,709, filed on Dec. 18, 2017, now Pat. No. 10,286,662, which is a continuation of application No. 15/061,451, filed on (Continued)

(30) Foreign Application Priority Data

Mar. 17, 2014 (JP) ..... 2014-053650

(51) Int. Cl.

| | |
|---|---|
| ***B41J 2/14*** | (2006.01) |
| ***B41J 2/175*** | (2006.01) |
| ***B41J 2/19*** | (2006.01) |

(52) U.S. Cl.

CPC ..... *B41J 2/14145* (2013.01); *B41J 2/1404* (2013.01); *B41J 2/14233* (2013.01); *B41J 2/175* (2013.01); *B41J 2/19* (2013.01); *B41J 2002/14306* (2013.01); *B41J 2002/14419* (2013.01); *B41J 2202/18* (2013.01)

(58) Field of Classification Search

CPC ..... B41J 2/14145; B41J 2/1404; B41J 2/19; B41J 2/175; B41J 2002/14306; B41J 2002/14419; B41J 2202/18

See application file for complete search history.

(56) References Cited

U.S. PATENT DOCUMENTS 6,488,355 B2 12/2002 Nakamura et al.
8,136,923 B2 * 3/2012 Ito ..... B41J 2/1623 347/50

(Continued)

FOREIGN PATENT DOCUMENTS

JP 2003-320664 11/2003
JP 2012-200918 10/2012

*Primary Examiner* — Geoffrey S Mruk
(74) *Attorney, Agent, or Firm* — Workman Nydegger

(57) ABSTRACT

A bifurcation path and a flow path which communicates with the head main body through the bifurcation path are provided. The bifurcation path includes an upstream-side path and a downstream-side path. In a plan view of a flow-path forming surface including the bifurcation path and the flow path, the flow path is disposed in a state where an angle between a flowing direction in the flow path and a flowing direction in the downstream-side path is an acute angle. In addition, an angle between a first wall surface of the flow path, which is the wall surface located downstream from the upstream-side path, and a second wall surface of the upstream-side path, which is the wall surface connected to the first wall surface, is equal to or less than 90°. Furthermore, the second wall surface of the upstream-side path has an R shape.

20 Claims, 19 Drawing Sheets

Related U.S. Application Data

Mar. 4, 2016, now Pat. No. 9,878,557, which is a continuation of application No. 14/659,265, filed on Mar. 16, 2015, now Pat. No. 9,315,020.

(56) References Cited

U.S. PATENT DOCUMENTS

| | | | |
|---|---|---|---|
| 9,315,020 | B2 | 4/2016 | Togashi |
| 9,878,557 | B2 | 1/2018 | Togashi |
| 2012/0160925 | A1 | 6/2012 | Hoisington et al. |
| 2017/0057244 | A1 | 3/2017 | Togashi |
| 2018/0117925 | A1 | 5/2018 | Togashi |

* cited by examiner

FLOW-PATH MEMBER, LIQUID EJECTING HEAD AND LIQUID EJECTING APPARATUS

CROSS REFERENCES TO RELATED APPLICATIONS

This application is a continuation of U.S. patent application Ser. No. 16/356,754, filed Mar. 18, 2019, which is a continuation of U.S. patent application Ser. No. 15/845,709, filed Dec. 18, 2017, which issued as U.S. Pat. No. 10,286,662 on May 14, 2019, which is a continuation of U.S. patent application Ser. No. 15/061,451, filed Mar. 4, 2016, which issued as U.S. Pat. No. 9,878,557 on Jan. 30, 2018, which is a continuation of U.S. patent application Ser. No. 14/659,265, filed Mar. 16, 2015, which issued as U.S. Pat. No. 9,315,020 on Apr. 19, 2016, which patent applications are incorporated herein by reference in their entireties. U.S. patent application Ser. No. 14/659,265 claims the benefit of and priority to Japanese Patent Application No. 2014-053650 filed on Mar. 17, 2014. The entire disclosure of Japanese Patent Application No. 2014-053650 is hereby incorporated herein by reference.

BACKGROUND

1. Technical Field

The present invention relates to a flow-path member, a liquid ejecting head, and a liquid ejecting apparatus and, particularly, relates to a flow-path member in which ink flows as a liquid, an ink jet type recording head which ejects ink supplied from the flow-path member, and an ink jet type recording apparatus.

2. Related Art

An ink jet type recording head which includes a head main body in which a pressure generation chamber communicating with a nozzle opening through which ink droplets are discharged is deformed by a pressure generation unit, such as a piezoelectric element, in such a manner that an ink droplet is discharged through the nozzle opening and a flow-path member which constitutes a flow path of ink supplied to the head main body is known as a liquid ejecting head.

A common manifold relating to respective pressure generation chambers is formed in the head main body. The manifold receives ink from the flow-path member and distributes the ink among the respective pressure generation chambers. Connection flow paths connecting the respective pressure generation chambers and the manifold are provided in the head main body. The connection flow paths communicate with the manifold, in a state where a flowing direction of ink in the connection flow path and a flowing direction of ink in the manifold have the same direction component. Accordingly, it is possible to allow ink to flow from the manifold to the connection flow paths while preventing the flow velocity of the ink from being extremely reduced. As a result, air bubbles are prevented from remaining in the connection flow paths, which result from a reduced flow velocity in the ink (see JP-A-2003-320664, for example).

However, in the case of the above-described configuration in which the flow velocity of ink is prevented from being reduced, the shapes or the arrangements of the manifold and the connection flow paths are limited. As a result, the degree of freedom in the configuration of a flow path, such as the manifold and the connection flow path, is reduced. Meanwhile, it is conceivable that the connection flow path and the manifold communicate with each other in a state where the flowing direction of ink in the connection flow path and the flowing direction of ink in the manifold have opposite direction components, in such a manner that the degree of freedom in the configuration of the flow path is ensured. However, in this configuration, there is a concern that the velocity of ink flowing from the manifold to the connection flow path may be reduced, and thus air bubbles may remain in the connection flow path.

Such a problem is not limited to the connection flow path which connects the manifold and the respective pressure generation chambers, in the head main body. The problem is shared by a flow-path member which has a flow path portion as a main flow path and a plurality of bifurcation flow path portions communicating with the flow path portion and in which ink is supplied from the flow path portion to a head main body through the bifurcation flow path portions, by connecting the bifurcation flow path portion and the head main body.

In other words, in the flow-path member having a configuration in which the flow path portion and the bifurcation flow path portions communicate with each other in a state where the flowing direction of ink in the bifurcation flow path portion and the flowing direction of ink in the flow path portion have the same direction component, it is possible to allow the ink to flow from the flow path portion to the bifurcation flow path portion while preventing the flow velocity of the ink from being extremely reduced. However, the arrangement of the bifurcation flow path portions and the flow path portion is limited, and thus the arrangement of the head main body is limited.

In contrast, in a flow-path member having a configuration in which a flow path portion and a bifurcation flow path portion communicate with each other in a state where the flowing direction of ink in the bifurcation flow path portion and the flowing direction of ink in the flow path portion have opposite direction components, it is possible to ensure a high degree of freedom in the configuration of the flow paths. However, there is a concern that the velocity of ink flowing from the flow path portion to the bifurcation flow path portion may be reduced, and thus air bubbles may remain in the bifurcation flow path portion.

Such a problem is not limited to a flow-path member which supplies ink to a head main body or an ink jet type recording head which discharges ink. The problem is shared by a flow-path member which supplies, to a head main body, liquid other than ink, a liquid ejecting head, and a liquid ejecting head which eject liquid.

SUMMARY

An advantage of some aspects of the invention is to provide a flow-path member in which the degree of freedom in the arrangement of a flow path and a head main body can be ensured and air bubbles can be prevented from remaining in a bifurcation flow path portion, a liquid ejecting head having the flow-path member, and a liquid ejecting apparatus.

Aspect 1

According to an aspect of the, there is provided a flow-path member which supplies liquid to a head main body which ejects the liquid from a liquid ejection surface. The flow-path member includes a first bifurcation flow path portion, and a first flow path portion which communicates with the head main body through the first bifurcation flow path portion. The first bifurcation flow path portion includes an upstream-side flow path portion which communicates with the first flow path portion, and a downstream-side flow path portion which communicates with the first flow path portion through the upstream-side flow path portion. Furthermore, in a plan view of a first flow-path forming surface including the first bifurcation flow path portion and the first flow path portion, the first flow path portion is disposed in a state where an angle between a flowing direction of liquid in the first flow path portion and a flowing direction of liquid in the downstream-side flow path portion is an acute angle. In addition, an angle between a first wall surface of wall surfaces of the first flow path portion, which is the wall surface located downstream from the upstream-side flow path portion, and a second wall surface of wall surfaces of the upstream-side flow path portion, which is the wall surface connected to the first wall surface, is equal to or less than 90°. Furthermore, the second wall surface of the upstream-side flow path portion has an R shape.

In this aspect, since the second wall surface of the upstream-side flow path portion has an R shape, it is easy for air bubbles to move along the second wall surface. Furthermore, since the angle between the first wall surface and the second wall surface is equal to or less than 90°, the air bubbles moving along the second wall surface can move from the upstream-side flow path portion to the downstream-side flow path portion. Furthermore, the air bubbles can be substantially evenly divided over the plurality of first bifurcation flow path portions, and then discharged to the outside of the flow-path member. In other words, the air bubbles can be prevented from collecting in a specific first bifurcation flow path portion. Accordingly, it is possible to reduce the possibility that the air bubbles may collect in the specific first bifurcation flow path portion, and thus ejection failure of ink occurs in the head main body communicating with the first bifurcation flow path portion. Furthermore, the flow-path member can have a configuration in which the head main bodies are freely arranged to meet the use or the purpose of the liquid ejecting head and the angle between the first flow path portion and the downstream-side flow path portion is set, in accordance with the arrangement of the head main bodies, to be an acute angle. In other words, it is possible to achieve both the degree of freedom in the arrangement of the head main bodies and the improvement in air-bubble discharge properties.

Aspect 2

In the flow-path member according to Aspect 1, it is preferable that the first bifurcation flow path portion further include a first vertical flow path which communicates with the upstream-side flow path portion through the downstream-side flow path portion and is perpendicular to the first flow-path forming surface. In addition, it is preferable that the cross-sectional area of the first vertical flow path be smaller than that of the downstream-side flow path portion. Furthermore, it is preferable that liquid in the first vertical flow path flow from the downstream-side flow path portion side to the head main body side. In this aspect, it is possible to increase the flow velocity of liquid in the first vertical flow path. As a result, it is easy for air bubbles in the liquid to flow through the first vertical flow path and, further, it is possible to further prevent the air bubbles from remaining in the downstream-side flow path portion.

Aspect 3

In the flow-path member according to Aspects 1 and 2, it is preferable that the flow-path member further include a second bifurcation flow path portion, and a second flow path portion which communicates with the head main body through the second bifurcation flow path portion. In addition, it is preferable that, in a second flow-path forming surface including the second bifurcation flow path portion and the second flow path portion, the second flow path portion be disposed in a state where an angle between a flowing direction of liquid in the second flow path portion and a flowing direction of liquid in the second bifurcation flow path portion is an obtuse angle and the flowing direction of liquid in the second flow path portion is opposite to the flowing direction of liquid in the first flow path portion. Furthermore, it is preferable that the first bifurcation flow path portion and the second bifurcation flow path portion communicate with the common head main body. In this aspect, it is possible to supply a plurality of liquids to one head main body and, further, air bubbles from the flow-path member can be prevented from being intensively sent to a specific head main body of the plurality of the head main bodies. In addition, the first flow path portion and the second flow path portion of which the angles in the middle of the flow paths are different from each other are used and thus, even when the plurality of liquids are supplied to the plurality of head main bodies, it is possible to improve the degree of freedom in the arrangement of the head main body.

Aspect 4

In the flow-path member according to Aspect 3, it is preferable that a flexible wiring substrate extending from the head main body side to the flow-path member side be connected to the head main body. Furthermore, it is preferable that the flexible wiring substrate be disposed in a portion between the first bifurcation flow path portion and the second bifurcation flow path portion. In this aspect, the size of the head main body and the flow-path member can be reduced.

Aspect 5

In the flow-path member according to Aspects 3 and 4, it is preferable that there be a plurality of liquids. Furthermore, it is preferable that a first liquid flowing in the first flow path portion and a second liquid flowing in the second flow path portion be different from each other. In this aspect, a plurality of different liquids can be supplied to one head main body.

Aspect 6

In the flow-path member according to Aspects 3 to 5, it is preferable that, among the plurality of liquids, a liquid having the most inferior air-bubble discharge properties do not flow in the first flow path portion. In this aspect, the liquid having the inferior air-bubble discharge properties flows through a flow path portion in which it is relatively easy for air bubbles to be discharged, compared to in the case of the first flow path portion. Thus, it is possible to further reduce the possibility that air bubbles may remain in the flow-path member.

Aspect 7

In the flow-path member according to Aspect 6, it is preferable that the air-bubble discharge properties be foaming properties or defoaming properties. In this aspect, in accordance with the foaming properties and the defoaming properties, it is possible to prevent liquid having the inferior air-bubble discharge properties from flowing through the first flow path portion.

Aspect 8

In the flow-path member according to Aspect 7, it is preferable that the air-bubble discharge properties be specified in order of foaming properties and defoaming properties. In this aspect, liquid in which air bubbles are likely to be generated can preferentially flow through a flow path portion other than the first flow path portion.

Aspect 9

In the flow-path member according to Aspects 3 to 8, it is preferable that, in a plan view of the liquid ejection surface, at least a part of the first flow path portion and a part of the second flow path portion overlap. In this aspect, the size of the flow-path member can be reduced in a plane direction of the liquid ejection surface, compared to in the case where all of the plurality of flow path portions are formed in the same plane.

Aspect 10

In the flow-path member according to Aspects 3 to 9, it is preferable that the flow-path member further include a first flow-path member, a second flow-path member, and a third flow-path member which are stacked in a direction perpendicular to the liquid ejection surface, in order away from the head main body. Furthermore, it is preferable that the first flow path portion be formed in a boundary portion between the first flow-path member and the second flow-path member. In addition, it is preferable that the second flow path portion be formed in a boundary portion between the second flow-path member and the third flow-path member. In this aspect, the first flow path portion and the second flow path portion can be formed by at least three members. As a result, the number of parts can be reduced.

Aspect 11

In the flow-path member according to Aspects 3 to 10, it is preferable that the first flow-path forming surface and the second flow-path forming surface be on the same plane. In this aspect, the thickness of the flow-path member in a direction perpendicular to the liquid ejection surface can be reduced, and thus the size of the flow-path member can be reduced.

Aspect 12

In the flow-path member according to Aspect 11, it is preferable that the flow-path member further include a first flow-path member and a second flow-path member which are stacked in a direction perpendicular to the liquid ejection surface, in order away from the head main body. Furthermore, it is preferable that the first flow path portion and the second flow path portion be formed in a boundary portion between the first flow-path member and the second flow-path member. In this aspect, since the flow paths can be formed by at least two members, it is possible to reduce the number of parts. Thus, it is possible to reduce the cost.

Aspect 13

According to another aspect of the invention, there is provided a liquid ejecting head which includes the flow-path member according to any one of Aspects 1 to 12 and a plurality of the head main bodies.

In this aspect, the liquid ejecting head includes the flow-path member in which the degree of freedom in the arrangement of the flow path and the head main body are ensured and air bubbles are prevented from remaining in the bifurcation flow path portion. Accordingly, the head main bodies are arranged without depending on the configuration of the flow path, and thus it is possible to achieve, for example, a reduction in the size of the liquid ejecting head. Furthermore, liquid ejection properties of the liquid ejecting head are improved.

Aspect 14

According to still another aspect of the invention, there is provided a liquid ejecting apparatus which includes the liquid ejecting head according to Aspect 13 described above.

In this aspect, the liquid ejecting apparatus includes the liquid ejecting head having the flow-path member in which the degree of freedom in the arrangement of the flow path and the head main body are ensured and air bubbles are prevented from remaining in the bifurcation flow path portion. Accordingly, the head main bodies are arranged without depending on the configuration of the flow path, and thus it is possible to achieve, for example, a reduction in the size of the liquid ejecting apparatus. Furthermore, liquid ejection properties of the liquid ejecting apparatus are improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

Figure 1:
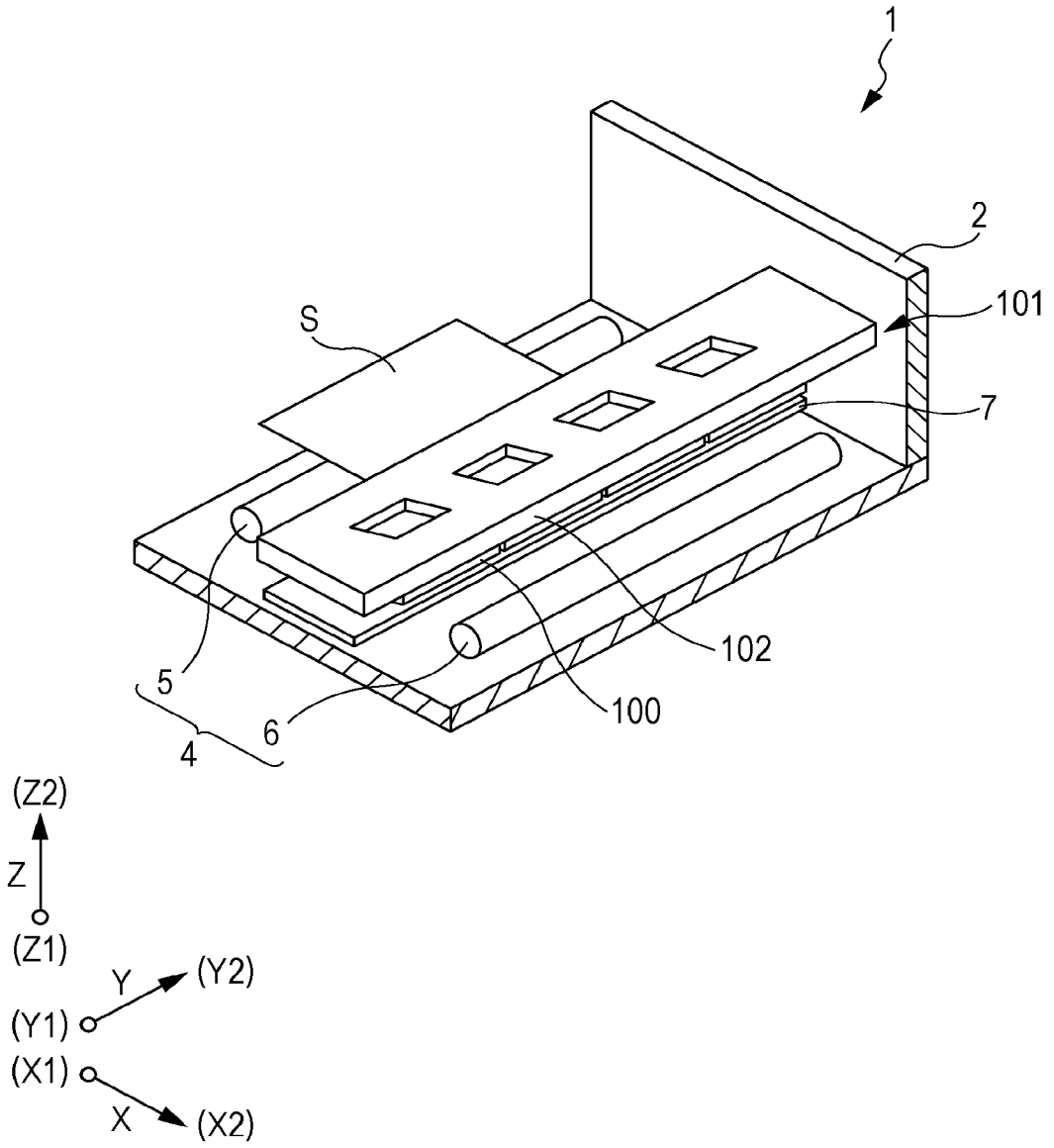
FIG. 1 is a schematic perspective view of a recording apparatus according to Embodiment 1 of the invention.

Details of embodiments of the invention will be described. An ink jet type recording head is an example of a liquid ejecting head and also referred to simply as a recording head. An ink jet type recording unit is an example of a liquid ejecting head unit and also referred to simply as a head unit. An ink jet type recording apparatus is an example of a liquid ejecting apparatus. FIG. 1 is a perspective view illustrating the schematic configuration of an ink jet type recording apparatus according to this embodiment.

An ink jet type recording apparatus 1 is a so-called line type recording apparatus, as illustrated in FIG. 1. The ink jet type recording apparatus 1 includes a head unit 101. In the ink jet type recording apparatus 1, a recording sheet S, such as a paper sheet as an ejection target medium, is transported, in such a manner that printing is performed.

Specifically, the ink jet type recording apparatus 1 includes an apparatus main body 2, the head unit 101, a transport unit 4, and a support member 7. The head unit 101 has a plurality of recording heads 100. The transport unit 4 transports the recording sheet S. The support member 7 supports the recording sheet S facing the head unit 101. In this embodiment, a transporting direction of the recording sheet S is set to an X direction. In a liquid ejection surface of the head unit 101, in which nozzle openings are provided, a direction perpendicular to the X direction is set to a Y direction. A direction perpendicular to both the X direction and the Y direction is set to a Z direction. In the X direction, an upstream direction in which the recording sheet S is transported is set to an X1 direction and a downstream direction is set to an X2 direction. In the Y direction, one direction is set to a Y1 direction and the other is set to a Y2 direction. In the Z direction, a direction (toward the recording sheet S) parallel to a liquid ejecting direction is set to a Z1 direction and an opposite direction is set to a Z2 direction.

The head unit 101 includes a plurality of recording heads 100 and a head fixing substrate 102 which holds a plurality of recording heads 100.

The plurality of recording heads 100 is fixed to the head fixing substrate 102, in a state where the recording heads 100 are aligned in the Y direction intersecting the X direction which is the transporting direction. In this embodiment, the plurality of recording heads 100 are aligned in a straight line extending in the Y direction. In other words, the plurality of recording heads 100 are arranged not to be shifted toward the X direction. Accordingly, the X-directional width of head unit 101 is reduced, and thus it is possible to reduce the size of the head unit 101.

The head fixing substrate 102 holds the plurality of recording heads 100, in a state where the nozzle openings of the plurality of recording heads 100 are directed to the recording sheet S. The head fixing substrate 102 holds a plurality of recording heads 100 and is fixed to the apparatus main body 2.

The transport unit 4 transports the recording sheet S in the X direction, with respect to the head unit 101. The transport unit 4 includes a first transport roller 5 and a second transport roller 6 which are provided, in relation with the head unit 101, for example, on both sides in the X direction as the transporting direction of the recording sheet S. The recording sheet S is transported, in the X direction, by the first transport roller 5 and the second transport roller 6. The transport unit 4 for transporting the recording sheet S is not limited to a transport roller. The transport unit 4 may be constituted of a belt, a drum, or the like.

The support member 7 supports the recording sheet S transported by the transport unit 4, at a position facing the head unit 101. The support member 7 is constituted of, for example, a metal member or a resin member of which the cross-sectional surface has a rectangular shape. The support member 7 is disposed in an area between the first transport roller 5 and the second transport roller 6, in a state where the support member 7 faces the head unit 101.

An adhesion unit which is provided in the support member 7 and causes the recording sheet S to adhere thereto may be provided in the support member 7. Examples of the adhesion unit include a unit which causes the recording sheet S to adhere thereto by sucking the recording sheet S and a unit which causes the recording sheet S to adhere thereto by electrostatically attracting the recording sheet S using electrostatic force. Furthermore, when the transport unit 4 is constituted of a belt or a drum, the support member 7 is located at a position facing the head unit 101 and causes the recording sheet S to be supported on the belt or the drum.

Although not illustrated, a liquid storage unit, such as an ink tank and an ink cartridge in which ink is stored, is connected to each recording head 100 of the head unit 101, in a state where the liquid storage unit can supply ink to the recording head 100. The liquid storage unit may be held on, for example, the head unit 101. Alternatively, in the apparatus main body 2, the liquid storage unit is held at a position separate from the head unit 101. A flow path and the like through which the ink supplied from the liquid storage unit is supplied to the recording head 100 may be provided in the inner portion of the head fixing substrate 102. Alternatively, an ink flow-path may be provided in the head fixing substrate 102 and ink from the liquid storage unit may be supplied to the recording head 100 through the ink flow-path member. Needless to say, ink may be directly supplied from the liquid storage unit to the recording head 100, without passing through the head fixing substrate 102 or the ink flow-path member fixed to the head fixing substrate 102.

In such an ink jet type recording apparatus 1, the recording sheet S is transported, in the X direction, by the first transport roller 5, and then the head unit 101 performs printing on the recording sheet S supported on the support member 7. The recording sheet S subjected to printing is transported, in the X direction, by the second transport roller 6.

Figure 2:
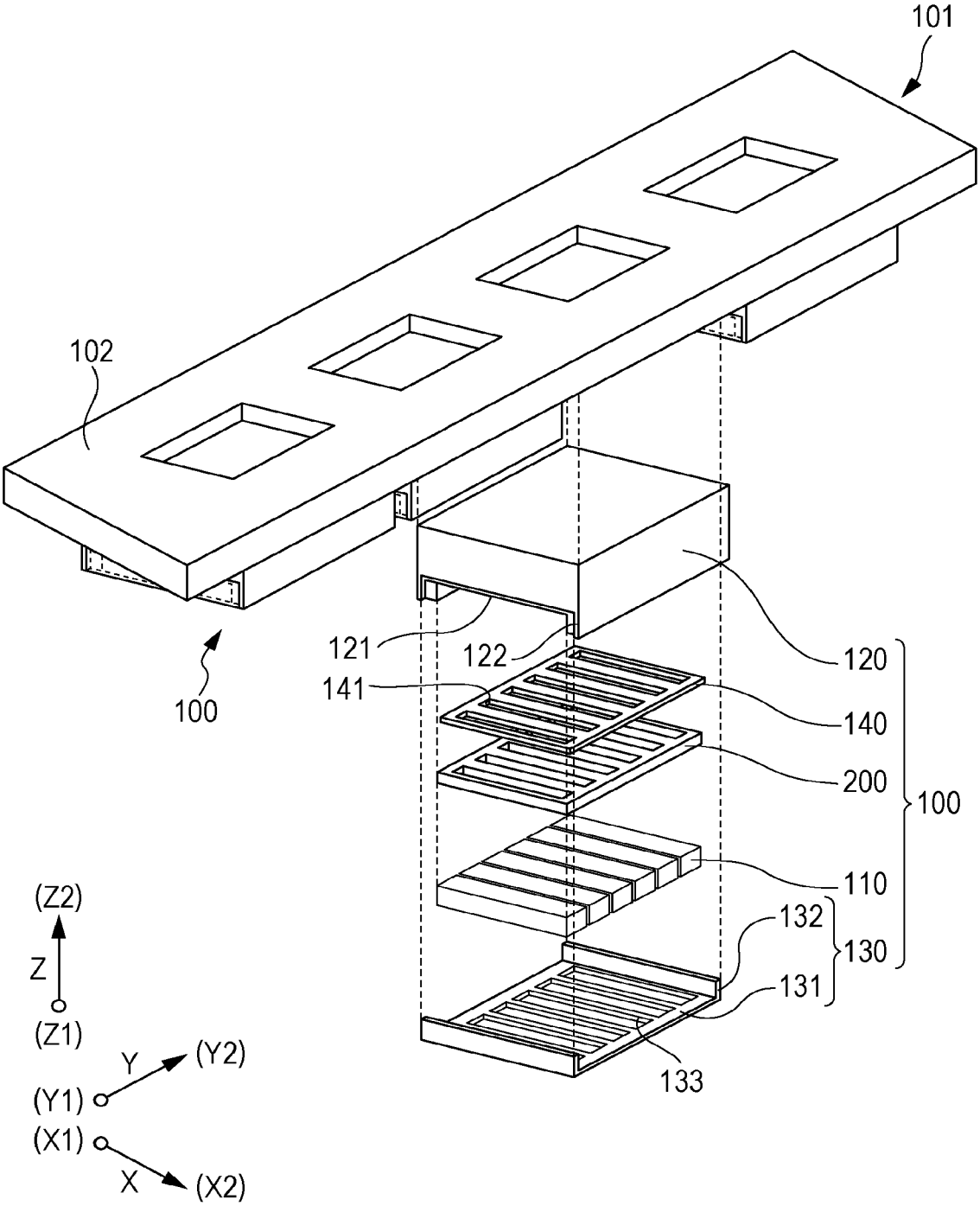
FIG. 2 is an exploded perspective view of a head unit according to Embodiment 1 of the invention.
Figure 3:
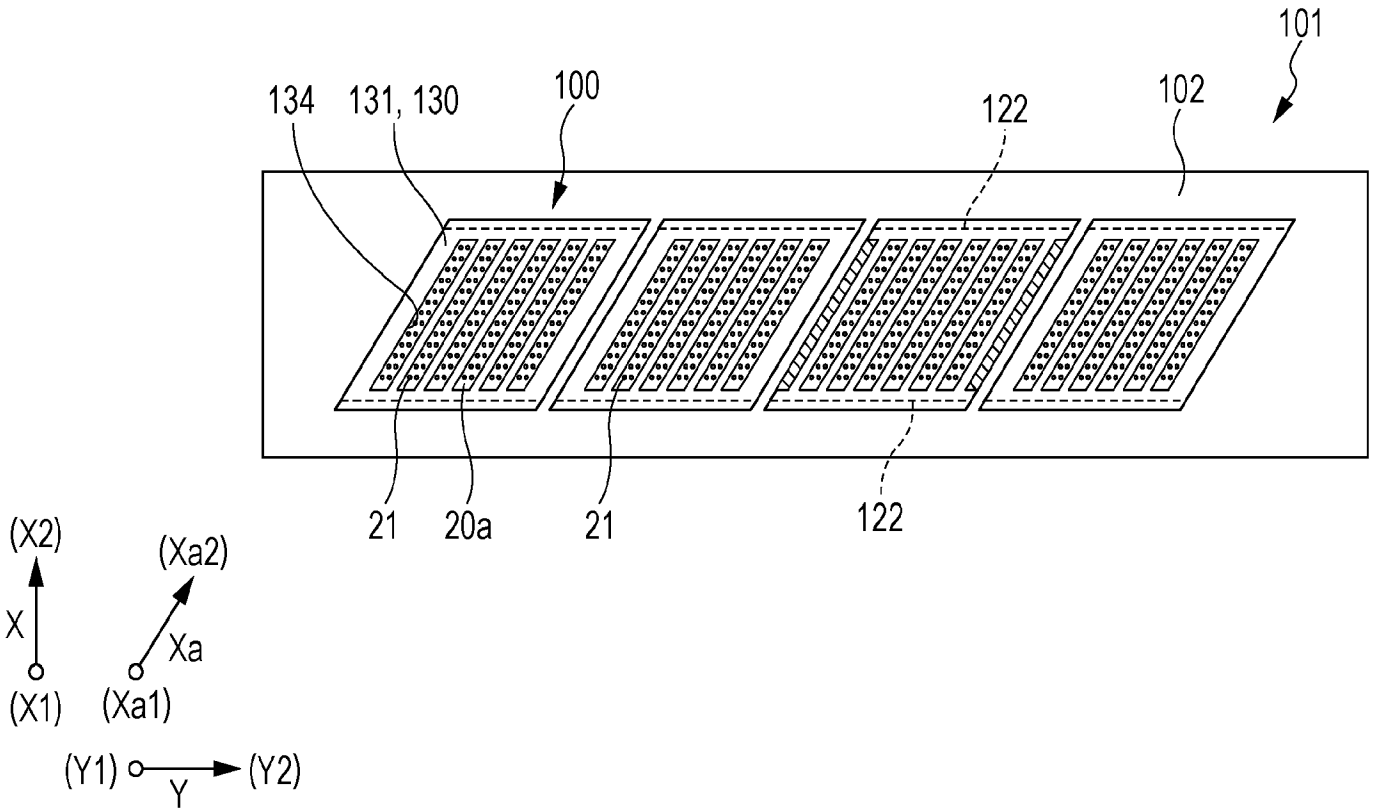
FIG. 3 is a bottom view of the head unit according to Embodiment 1 of the invention.

Details of the head unit 101 will be described with reference to FIGS. 2 and 3. FIG. 2 is an exploded perspective view illustrating the head unit according to this embodiment and FIG. 3 is a bottom view of the head unit, when viewed from the liquid ejection surface side.

The head unit 101 of this embodiment includes a plurality of recording heads 100 and the head fixing substrate 102 which holds the plurality of recording heads 100. In the recording head 100, a liquid ejection surface 20*a* which includes nozzle openings 21 is provided on the Z1 side in the Z direction. Each recording head 100 is fixed to a surface of the head fixing substrate 102, which is the surface facing the recording sheet S. In other words, the recording head 100 is fixed to the Z1 side, that is, the side facing the recording sheet S, of the head fixing substrate 102 in the Z direction.

As described above, the plurality of recording heads 100 are fixed to the head fixing substrate 102, in a state where the recording heads 100 are aligned on a straight line extending in the Y direction perpendicular to the X direction which is the transporting direction. In other words, the plurality of recording heads 100 are arranged not to be shifted toward the X direction. Accordingly, the X-directional width of the head unit 101 is reduced, and thus it is possible to reduce the size of the head unit 101. Needless to say, the recording heads 100 aligned in the Y direction may be arranged to be shifted toward the X direction. However, in this case, when the recording heads 100 are greatly shifted toward the X direction, for example, the X-directional width of the head fixing substrate 102 increases. When the X-directional size of the head unit 101 increases, as described above, the X-directional distance between the first transport roller 5 and the second transport roller 6 increases in the ink jet type recording apparatus 1. As a result, it is difficult to fix the posture of the recording sheet S. In addition, the size of the head unit 101 and the ink jet type recording apparatus 1 increases.

In this embodiment, four recording heads 100 are fixed to the head fixing substrate 102. However, the configuration is not limited thereto, as long as the number of recording heads 100 is two or more.

Figure 4:
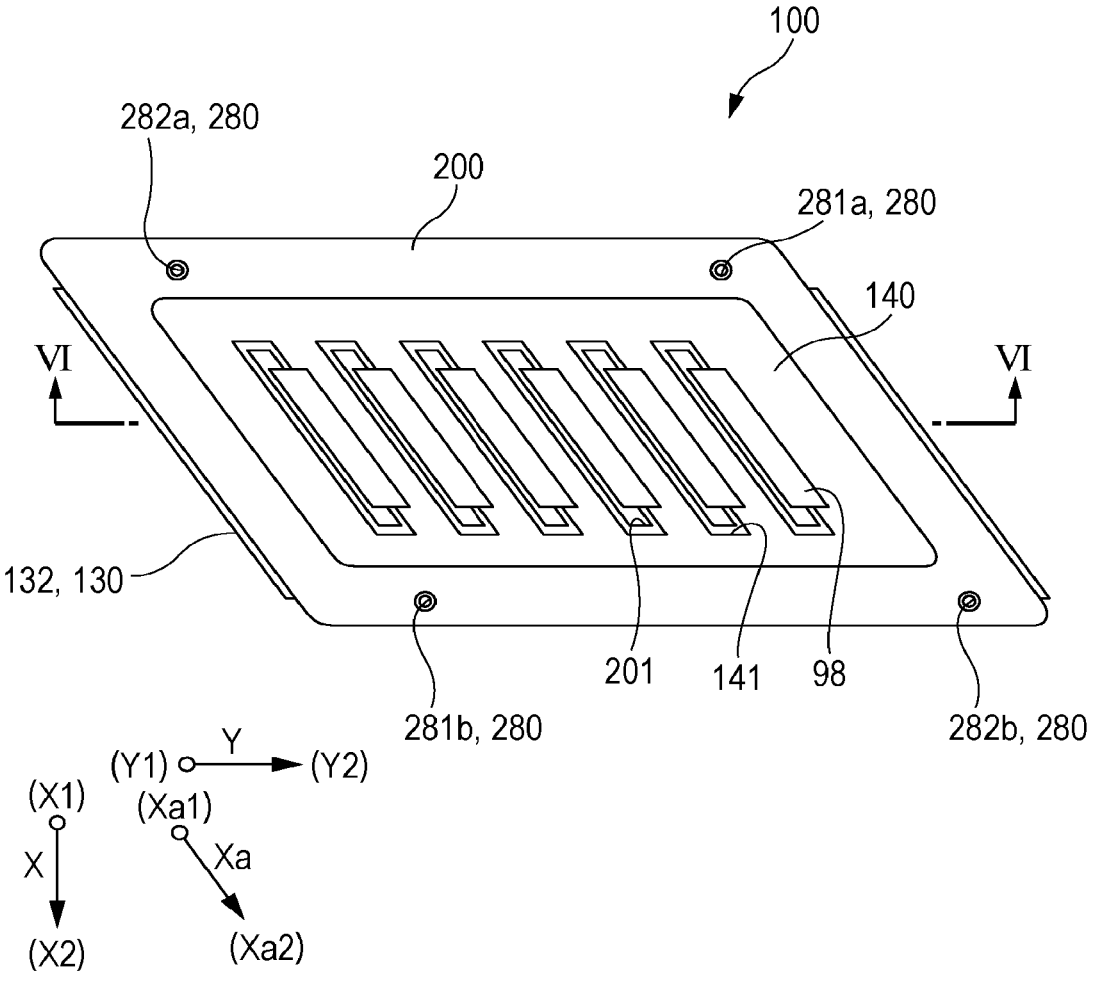
FIG. 4 is a plan view of a recording head according to Embodiment 1 of the invention.
Figure 5:
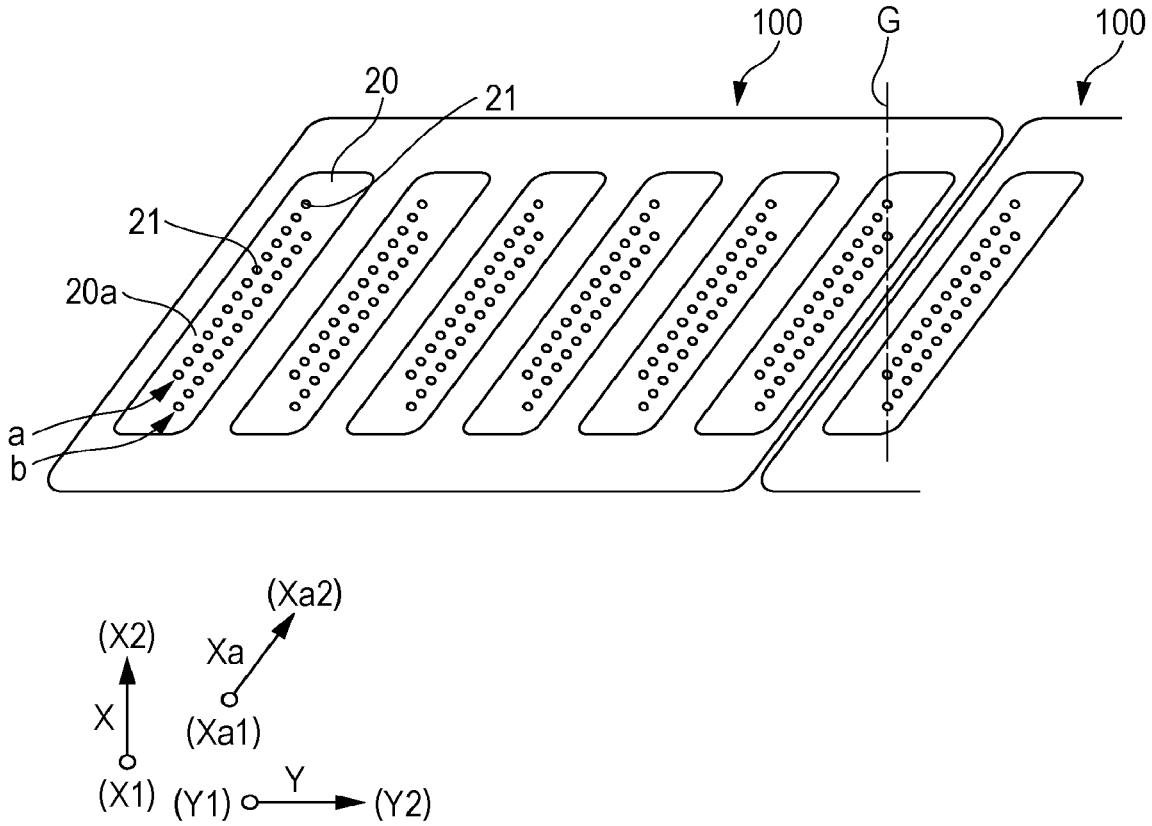
FIG. 5 is a bottom view of the recording head according to Embodiment 1 of the invention.
Figure 6:
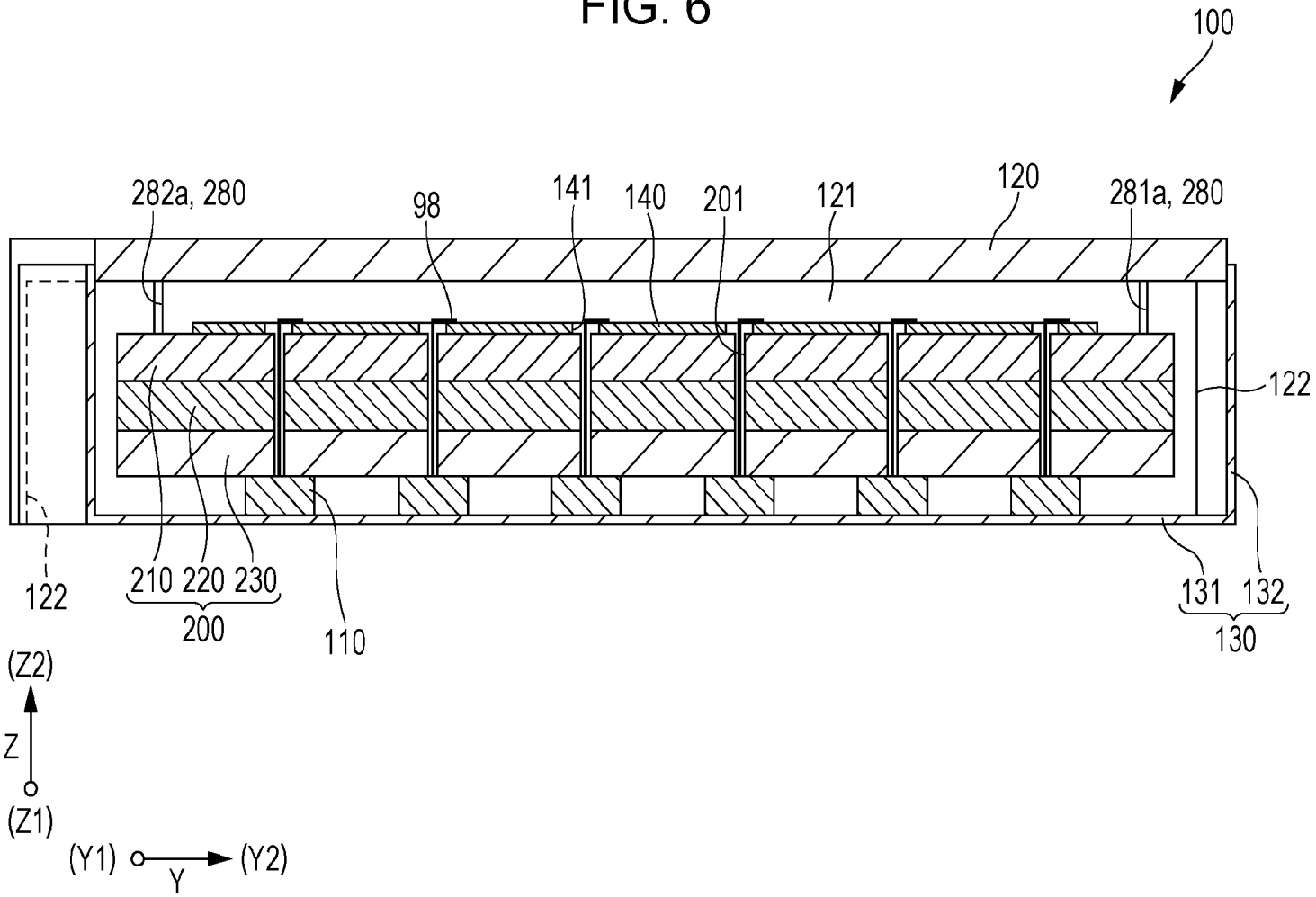
FIG. 6 is a cross-sectional view of FIG. 4, taken along line VI-VI.

Next, the recording head 100 will be described with reference to FIG. 2 and FIGS. 4 to 6. FIG. 4 is a plan view of the recording head and FIG. 5 is a bottom view of the recording head. FIG. 6 is a cross-sectional view of FIG. 4, taken along a line VI-VI. FIG. 4 is a plan view of the recording head 100, when viewed from the Z2 side in the Z direction. A holding member 120 is not illustrated in FIG. 4.

The recording head 100 includes the plurality of head main bodies 110, COF substrates 98, and a flow-path member 200. The COF substrates 98 are respectively connected to the head main bodies 110. Flow paths through which ink is supplied to respective head main bodies are provided in the flow-path member 200. Furthermore, in this embodiment, the recording head 100 includes the holding member 120, a fixing plate 130, and a relay substrate 140. The holding member 120 holds the plurality of head main bodies 110. The fixing plate 130 is provided on the liquid ejection surface 20*a* side of the head main body 110.

The head main body 110 receives ink from the holding member 120 and the flow-path member 200 in which ink flow paths are provided. Control signals are transmitted from a controller (not illustrated) in the ink jet type recording apparatus 1 to the head main body 110, via both the relay substrate 140 and the COF substrate 98 and the head main body 110 discharges ink droplets in accordance with the control signals. Details of the configuration of the head main body 110 will be described below.

In each head main body 110, the liquid ejection surface 20*a* in which nozzle openings 21 are formed is provided on the Z1 side in the Z direction. Z2 sides of the plurality of head main bodies 110 adhere to the Z1-side surface of the flow-path member 200.

Liquid flow paths for ink supplied to the head main body 110 are provided in the flow-path member 200. The plurality of head main bodies 110 adhere to the Z1-side surface of the flow-path member 200, in a state where the plurality of head main bodies 110 are aligned in the Y direction. Details of the configuration of the flow-path member 200 will be described below. The liquid flow paths in the flow-path member 200 communicate with liquid flow paths of the respective head main bodies 110, in such a manner that ink is supplied from the flow-path member 200 to the respective head main bodies 110.

In this embodiment, six head main bodies 110 adhere to one flow-path member 200. Needless to say, the number of head main bodies 110 fixed to one flow-path member 200 is not limited to six. One head main body 110 may be fixed for each flow-path member 200 or two or more head main bodies 110 may be fixed for each flow-path member 200.

An opening portion 201 is provided in the flow-path member 200, in a state where the opening portion 201 passes through the flow-path member 200 in the Z direction. The COF substrate 98 of which one end is connected to the head main body 110 is inserted through the opening portion 201.

The COF substrate 98 is an example of a flexible wiring substrate. A flexible wiring substrate is a flexible substrate having wiring formed thereon. Furthermore, the COF substrate 98 includes a driving circuit 97 (see FIG. 7) which drives a pressure generation unit in the head main body 110.

The relay substrate 140 is a substrate on which electrical components, such as wiring, an IC, and a resistor, are mounted. The relay substrate 140 is disposed in a portion between the holding member 120 and the flow-path member 200. A passing-through portion 141 communicating with the opening portion 201 in the flow-path member 200 is formed in the relay substrate 140. The size of the opening of each passing-through portion 141 is greater than that of the opening portion 201 of the flow-path member 200.

The COF substrate 98 connected to the pressure generation unit of the head main body 110 is inserted through both the opening portion 201 and the passing-through portion 141. The COF substrate 98 is connected to a terminal (not illustrated) in the Z2-side surface of the relay substrate 140.

Although not particularly illustrated, the relay substrate 140 is connected to the controller of the ink jet type recording apparatus 1. Accordingly, for example, the driving signals sent from the controller are transmitted, through the relay substrate 140, to the driving circuit 97 of the COF substrate 98. The pressure generation unit of the head main body 110 is driven by the driving circuit 97. Therefore, an ink ejection operation of the recording head 100 is controlled.

On the Z1 side of the holding member 120, a hold portion 121 is provided to form a space having a groove shape. On the Z1-side surface of the holding member 120, the hold portion 121 continuously extends in the Y direction, and thus the hold portion 121 is open to both side surfaces of the holding member 120 in the Y direction. Furthermore, the hold portion 121 is provided in a substantially central portion of the holding member 120 in the X direction, and thus leg portions 122 are formed on both sides of the hold portion 121 in the X direction. In other words, in the Z1-side surface of the holding member 120, the leg portions 122 are provided in only both end portions in the X direction and are not provided in both end portions in the Y direction. In this embodiment, the holding member 120 is constituted of one member. However, the configuration of the holding member 120 is not limited thereto. The holding member 120 may be constituted of a plurality of members stacked in the Z direction.

The relay substrate 140, the flow-path member 200, and the plurality of head main body 110 are accommodated in such a hold portion 121. Specifically, the respective head main bodies 110 are bonded to the Z1-side surface of the flow-path member 200, using, for example, an adhesive. Furthermore, the relay substrate 140 is fixed to the Z2-side surface of the flow-path member 200. The relay substrate 140, the flow-path member 200, and the plurality of head main bodies 110 which are bonded into a single member are accommodated in the hold portion 121.

In the holding member 120 and the flow-path member 200, the Z-direction facing surfaces of the hold portion 121 and the flow-path member 200 adhere to each other, using an adhesive. The relay substrate 140 is accommodated in a space between the hold portion 121 and the flow-path member 200. The holding member 120 and the flow-path member 200 may be integrally fixed using a fixing unit, such as a screw, instead of using an adhesive.

Although not particularly illustrated, a flow path through which ink flows, a filter which filters out, for example, foreign matter, and the like may be provided in the holding member 120. The flow path of the holding member 120 communicates with the liquid flow path of the flow-path member 200. Accordingly, the ink fed from the liquid storage unit in the ink jet type recording apparatus 1 is supplied to the head main body 110 via both the holding member 120 and the flow-path member 200.

The fixing plate 130 is provided on the liquid ejection surface 20*a* side of the recording head 100. In other words, the fixing plate 130 is provided on the Z1 side of the recording head 100 in the Z direction and holds the respective recording heads 100. The fixing plate 130 is formed by bending a plate-shaped member constituted of, for example, metal. Specifically, the fixing plate 130 includes a base portion 131 and bent portions 132. The base portion 131 is provided on the liquid ejection surface 20*a* side of the fixing plate 130. Both end portions of the base portion 131 in the Y direction is bent in the Z2 direction, in such a manner that the bent portions 132 is formed.

Exposure opening portions 133 are provided in the base portion 131. The exposure opening portions 133 are openings for exposing the nozzle openings 21 of the respective head main bodies 110. In this embodiment, the exposure opening portions 133 are open in a state where the exposure opening portions 133 separately respectively correspond to the head main bodies 110. In other words, the recording head 100 of this embodiment has the six head main bodies 110, and thus six separate exposure opening portions 133 are provided in the base portion 131. Needless to say, one common exposure opening portion 133 may be provided with respect to a head main body group constituted of a plurality of head main bodies 110, in accordance with, for example, the configuration of the head main body 110.

The Z1 side of the hold portion 121 of the holding member 120 is covered with such a base portion 131. The base portion 131 is bonded, using an adhesive, to the Z1-side surface of the holding member 120 in the Z direction, in other words, the Z1-side end surfaces of the leg portion 122, as illustrated in FIG. 6.

The bent portions 132 are provided on both end portions of the base portion 131 in the Y direction. The bent portions 132 have the size capable of covering the opening areas of the hold portion 121, which are open in the Y-direction side surfaces of the hold portion 121. In other words, the bent portion 132 is a portion extending from the Y-direction end portion of the base portion 131 to the edge portion of the fixing plate 130. In addition, such a bent portion 132 is bonded, using an adhesive, to the Y-direction side surface of the holding member 120. Accordingly, the openings of the hold portion 121, which are open in the Y-direction side surfaces of the hold portion 121, is covered and sealed with the bent portions 132.

The fixing plate 130 adheres, using an adhesive, to the holding member 120, as described above, and thus the head main body 110 is disposed in the inner portion of the hold portion 121, which is a space between the holding member 120 and the fixing plate 130.

The plurality of head main bodies 110 are provided in each recording head 100, in such a manner that the recording head 100 of this embodiment has a plurality of nozzle rows, as described above. In this case, it is possible to improve a yield, compared to in a case where a plurality of nozzle rows are provided in only one head main body 110, in such a manner that one recording head 100 has a plurality of nozzle rows. In other words, when a plurality of nozzle rows are provided by one head main body 110, the yield of the head main body 110 decreases and a manufacturing cost increases. In contrast, when a plurality of nozzle rows are provided by a plurality of head main bodies 110, the yield of the head main body 110 is improved and the manufacturing cost can be reduced.

The openings in the Y-direction side surfaces of the holding member 120 are sealed with the bent portions 132 of the fixing plate 130. Accordingly, even when leg portions which adhere to the base portion 131 of the fixing plate 130 are not provided on both sides (which are hatched portions in FIG. 3) of the holding member 120 in the Y direction, it is possible to prevent moisture evaporation from occurring through the openings in the Y-direction side surfaces of the hold portion 121.

Accordingly, in the head unit 101 in which the recording heads 100 are aligned in the Y direction, a gap between adjacent recording heads 100 in the Y direction can be reduced because the leg portions 122 are not provided on the Y-direction sides of the adjacent recording heads 100. Accordingly, the head main bodies 110 of adjacent recording heads 100 in the Y direction can be arranged close to each other, and thus the nozzle openings 21 of the respective head main bodies 110 of the adjacent recording heads 100 can be arranged close to each other in the Y direction.

In the recording head 100 according to this embodiment, the leg portions 122 are provided on both sides of the holding member 120 in the X direction. However, the leg portions 122 may not be provided. In other words, the head main body 110 may adhere to the Z1-side surface of the holding member 120 and the bent portions 132 may be provided on both sides of the fixing plate 130 in the X direction and on both sides thereof in the Y direction. That is, the bent portions 132 may be provided over the circumference of the fixing plate 130, in an in-plane direction of the liquid ejection surface 20*a*, and the fixing plate 130 adheres over the circumference of the side surfaces of the holding member 120. However, when the leg portions 122 are provided on both sides of the holding member 120 in the X direction, as in the case of this embodiment, the Z1-side end surfaces of the leg portion 122 adhere to the base portion 131 of the fixing plate 130. As a result, the hardness of the ink jet type recording head 100 in the Z direction can be improved and it is possible to prevent moisture evaporation from occurring through the leg portions 122.

Figure 7:
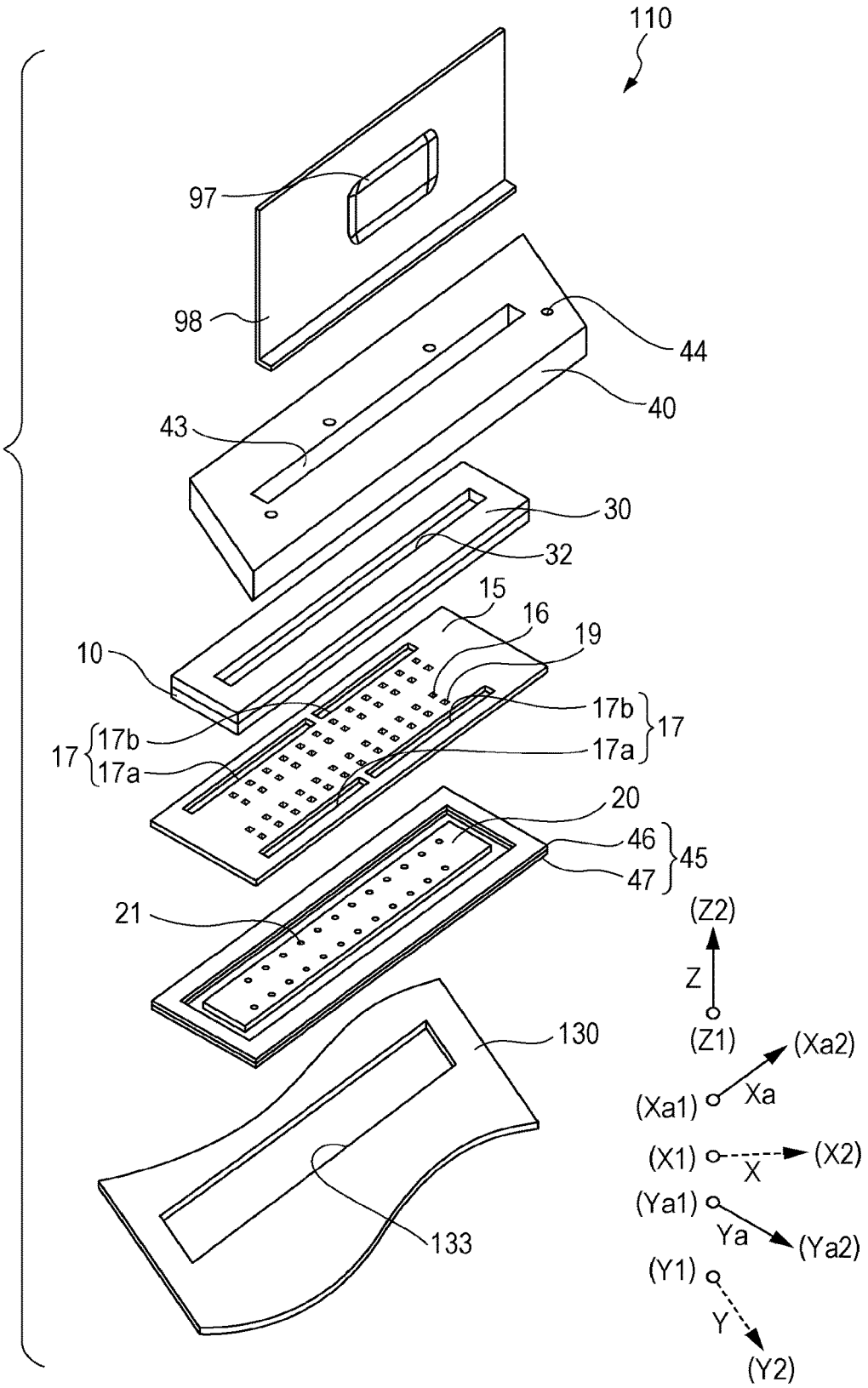
FIG. 7 is an exploded perspective view of a head main body according to Embodiment 1 of the invention.
Figure 8:
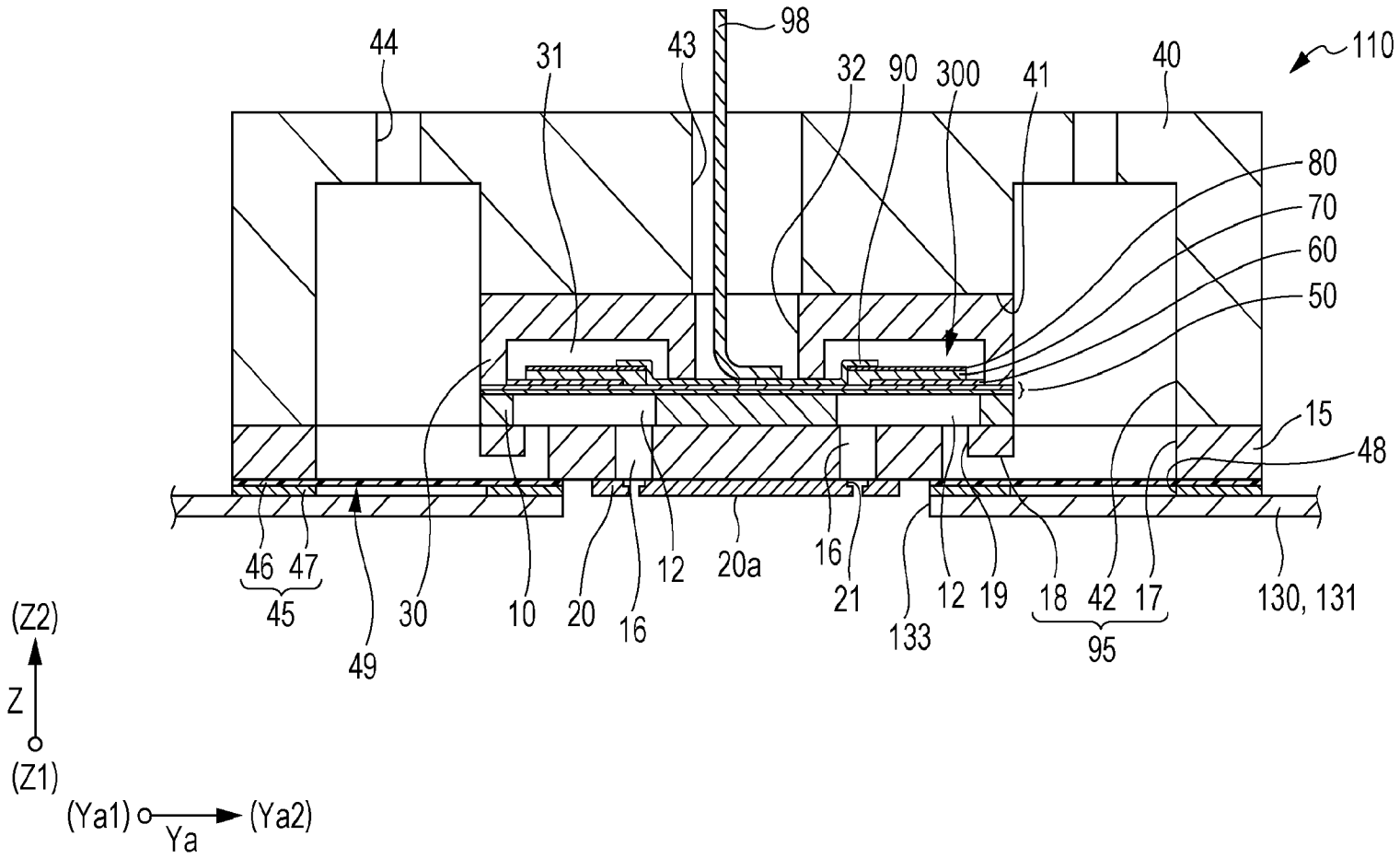
FIG. 8 is a cross-sectional view of the head main body according to Embodiment 1 of the invention.

The head main body 110 will be described with reference to FIGS. 7 and 8. FIG. 7 is an exploded perspective view of the head main body according to this embodiment and FIG. 8 is a cross-sectional view of the head main body, taken along a line extending in the Y direction. Needless to say, the configuration of the head main body 110 is not limited to the configuration described below.

The head main body 110 of this embodiment includes a pressure generation chamber 12, the nozzle openings 21, a manifold 95, the pressure generation unit, and the like. Therefore, a plurality of members, such as a flow-path forming substrate 10, a communication plate 15, a nozzle plate 20, a protection substrate 30, a compliance substrate 45, a case 40 and the like are bonded, using, for example, an adhesive, to one another.

One surface side of the flow-path forming substrate 10 is subjected to anisotropic etching, in such a manner that a plurality of pressure generation chambers 12 partitioned by a plurality of partition walls are provided in the flow-path forming substrate 10, in a state where the pressure generation chambers 12 are aligned in an aligning direction of a plurality of the nozzle openings 21. In this embodiment, the aligning direction of the pressure generation chambers 12 is referred to as the Xa direction. Furthermore, a plurality (two, in this embodiment) of rows, each of which is constituted of the pressure generation chambers 12 aligned in the Xa direction, are provided in the flow-path forming substrate 10. A row-aligning direction in which a plurality of rows of the pressure generation chambers 12 are aligned will be referred to as a Ya direction. In this embodiment, a direction perpendicular to both the Xa direction and the Ya direction is parallel to the Z direction. Furthermore, the head main body 110 of this embodiment is mounted on the head unit 101, in a state where the Xa direction as an aligning direction of the nozzle openings 21 is inclined with respect to the X direction as the transporting direction of the recording sheet S.

A supply path of which the opening area is smaller than that of the pressure generation chamber 12 and which imparts a flow-path resistance to the ink flowing to the pressure generation chamber 12 may be provided in the flow-path forming substrate 10 in one end side of the Ya direction of the pressure generation chamber 12.

The communication plate 15 is bonded to one surface side of the flow-path forming substrate 10. Furthermore, the nozzle plate 20 in which a plurality of nozzle openings 21 communicating with the respective pressure generation chambers 12 are provided is bonded to the communication plate 15. In this embodiment, the Z1 side of the nozzle plate 20 in the Z direction, on which the nozzle openings 21 are open, is the liquid ejection surface 20*a*.

A nozzle communication path 16 which allows the pressure generation chamber 12 to communicate with the nozzle opening 21 is provided in the communication plate 15. The area of the communication plate 15 is greater than that of the flow-path forming substrate 10 and the area of the nozzle plate 20 is smaller than that of the flow-path forming substrate 10. The nozzle plate 20 has a relatively small area, as described above. As a result, it is possible to achieve a reduction in costs.

A first manifold 17 and a second manifold 18 which constitute a part of the manifold 95 is provided in the communication plate 15. The first manifold 17 passes through the communication plate 15 in the Z direction. The second manifold 18 does not pass through the communication plate 15 in the Z direction. The second manifold 18 is open to the nozzle plate 20 side of the communication plate 15 and extends to the Z-direction middle portion of the nozzle plate 20.

Supply communication paths 19 which communicate with one end portions of the pressure generation chambers 12 in the Y direction is provided in the communication plate 15, in a state where the supply communication paths 19 separately respectively correspond to the pressure generation chambers 12. The supply communication path 19 allows the second manifold 18 to communicate with the pressure generation chamber 12.

The nozzle openings 21 which respectively communicate with the pressure generation chambers 12 through the nozzle communication path 16 is formed in the nozzle plate 20. The plurality of nozzle openings 21 are aligned in the Xa direction. The aligned nozzle openings 21 form two nozzle rows which are a nozzle row a and a nozzle row b. The nozzle row a and the nozzle row b are aligned in the Ya direction. In this embodiment, each of the nozzle rows a and b is divided into two portions, and thus one nozzle row can eject liquids of two kinds. Details of this will be described below.

Meanwhile, a diaphragm 50 is formed on a surface of the flow-path forming substrate 10, which is the surface on the side opposite to the communication plate 15. A first electrode 60, a piezoelectric layer 70, and a second electrode 80 are laminated, in order, on the diaphragm 50, in such a manner that a piezoelectric actuator 300 as the pressure generation unit of this embodiment is constituted. Generally, one electrode of the piezoelectric actuator 300 is constituted of a common electrode. The other electrodes and the piezoelectric layers are subjected to patterning such that the other electrode and the piezoelectric layer correspond to each pressure generation chamber 12.

The protection substrate 30 having the substantially same size as that of the flow-path forming substrate 10 is bonded to a surface of the flow-path forming substrate 10, which is the surface on the piezoelectric actuator 300 side. The protection substrate 30 has a hold portion 31 which is a space for protecting the piezoelectric actuator 300. Furthermore, in the protection substrate 30, a through-hole 32 is provided in a state where the through-hole 32 passes through the protection substrate 30 in the Z direction. An end portion of a lead electrode 90 extending from the electrode of the piezoelectric actuator 300 extends such that the end portion is exposed to the inner portion of the through-hole 32. The lead electrode 90 and the COF substrate 98 are electrically connected in the through-hole 32.

Furthermore, the case 40 which forms manifolds 95 communicating with a plurality of pressure generation chambers 12 is fixed to both the protection substrate 30 and the communication plate 15. In a plan view, the case 40 and the communication plate 15 described above have the substantially same shape. The case 40 is bonded to the protection substrate 30 and, further, bonded to the communication plate 15 described above. Specifically, a concave portion 41 is provided on the protection substrate 30 side of the case 40. The depth of the concave portion 41 is enough to accommodating both the flow-path forming substrate 10 and the protection substrate 30. The opening area of the concave portion 41 is greater than that of a surface of the protection substrate 30, which is the surface bonded to the flow-path forming substrate 10. An opening surface of the concave portion 41, which is the opening surface on the nozzle plate 20 side, is sealed with the communication plate 15, in a state where the flow-path forming substrate 10 and the like are accommodated in the concave portion 41. Accordingly, in the outer circumferential portion of the flow-path forming substrate 10, a third manifold 42 is formed by the case 40, the flow-path forming substrate 10, and the protection substrate 30. The manifold 95 of this embodiment is constituted of the third manifold 42, the first manifold 17, and the second manifold 18, in which the first manifold 17 and the second manifold 18 are provided in the communication plate 15. Liquids of two kinds can be ejected by one nozzle row, as described above. Thus, each of the first manifold 17, the second manifold 18, and the third manifold 42 which constitute the manifold 95 is divided into two portions, in a nozzle-row direction, that is, the Xa direction. The first manifold 17 is constituted of, for example, a first manifold 17*a* and a first manifold 17*b*, as illustrated in FIG. 7. Similarly, each of the second manifold 18 and the third manifold 42 is also divided into two portions. Thus, the entirety of the manifold 95 is divided into two portions, in the Xa direction.

In this embodiment, the first manifolds 17, the second manifolds 18, and the third manifolds 42 which constitute the manifolds 95 are symmetrically arranged with the nozzle rows a and b interposed therebetween. In this case, the nozzle row a and the nozzle row b can eject different liquids. Needless to say, the arrangement of the manifolds is not limited thereto.

In this embodiment, each of the manifolds corresponding to the respective nozzle rows is divided into two portions, in the Xa direction. Accordingly, in total, four manifolds 95 are provided such that liquids of four kinds can be ejected, as described below. However, manifolds may be provided corresponding to nozzle rows a and b. Alternatively, one common manifold may be provided with respect to the two rows which are the nozzle row a and the nozzle row b.

The compliance substrate 45 is provided in a surface of the communication plate 15, in which both the first manifold 17 and the second manifold 18 are open. The openings of both the first manifold 17 and the second manifold 18 are sealed with the compliance substrate 45.

In this embodiment, such a compliance substrate 45 includes a sealing film 46 and a fixing substrate 47. The sealing film 46 is constituted of a flexible thin film (which is formed of, for example, polyphenylene sulfide (PPS) or stainless steel (SUS)). The fixing substrate 47 is constituted of a hard material, for example, metal, such as stainless metal (SUS). A part of the fixing substrate 47, which is the portion facing the manifold 95, is completely removed in a thickness direction and forms an opening portion 48. Thus, one surface of the manifold 95 forms a compliance portion 49 which is a flexible portion sealed with only the sealing film 46 having flexibility.

The fixing plate 130 adheres to a surface of the compliance substrate 45, which is the surface on a side opposite to the communication plate 15. In other words, the opening area of the exposure opening portion 133 of the base portion 131 of the fixing plate 130 is a greater than the area of the nozzle plate 20. The liquid ejection surface 20*a* of the nozzle plate 20 is exposed through the exposure opening portion 133. Needless to say, the configuration is not limited thereto. The opening area of the exposure opening portion 133 of the fixing plate 130 may be smaller than the size of the nozzle plate 20 and the fixing plate 130 may abut on or adhere to the liquid ejection surface 20*a* of the nozzle plate 20. Alternatively, even when the opening area of the exposure opening portion 133 of the fixing plate 130 is smaller than the size of the nozzle plate 20, the fixing plate 130 may be provided in a state where the fixing plate 130 is not in contact with the liquid ejection surface 20*a*. In other words, the meaning of "the fixing plate 130 is provided on the liquid ejection surface 20*a* side" includes both a state where the fixing plate 130 is not in contact with the liquid ejection surface 20*a* and a state where the fixing plate 130 is in contact with the liquid ejection surface 20*a*.

An introduction path 44 is provided in the case 40. The introduction path 44 communicates with the manifold 95 and allows ink to be supplied to the manifold 95. In addition, a connection port 43 is provided in the case 40. The connection port 43 communicates with the through-hole 32 of the protection substrate 30 and the COF substrate 98 is inserted therethrough.

In the head main body 110 configured as described above, when ink is ejected, ink is fed from a storage unit through the introduction path 44 and the flow path from the manifold 95 to the nozzle openings 21 is filled with the ink. Then, voltage is applied, in accordance with signals from the driving circuit 97, to each piezoelectric actuator 300 corresponding to the pressure generation chamber 12, in such a manner that the diaphragm, along with the piezoelectric actuator 300, is flexibly deformed. As a result, the pressure in the pressure generation chamber 12 increases, and thus ink droplets are ejected from predetermined nozzle openings 21.

Figure 9:
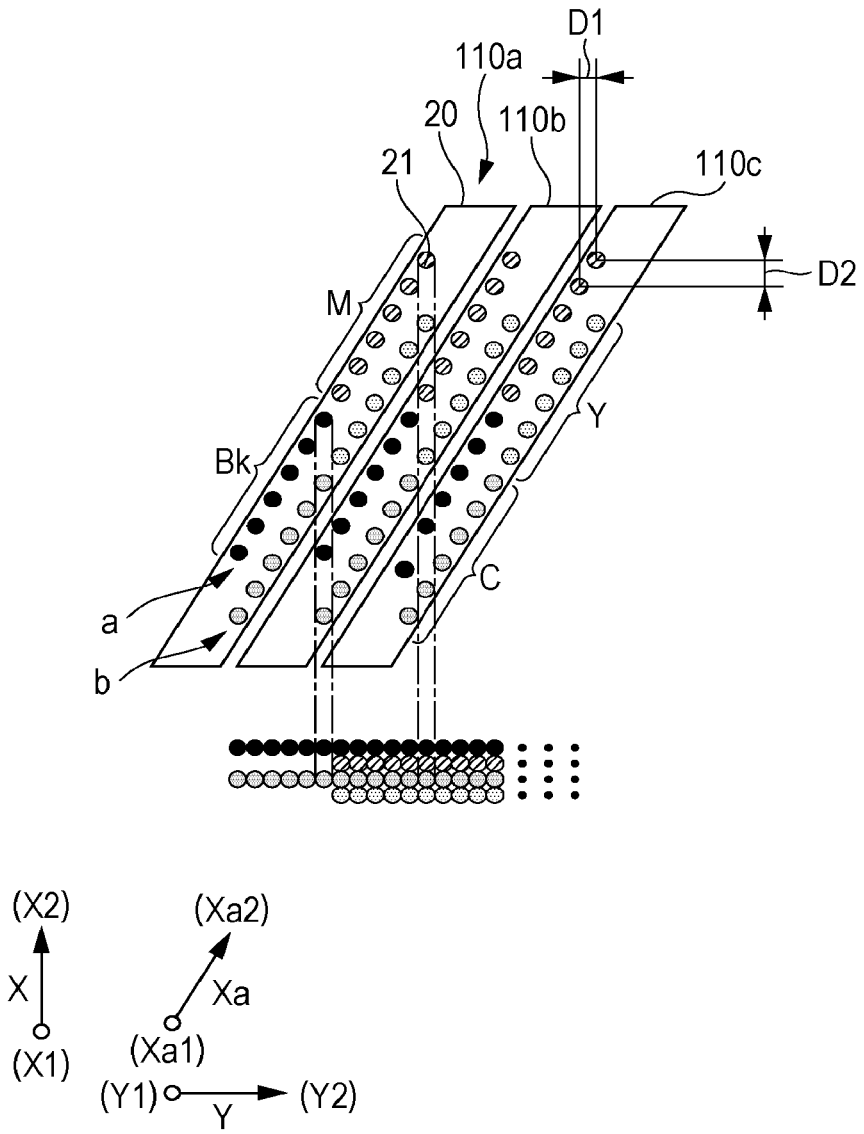
FIG. 9 is a schematic view illustrating the arrangement of nozzle openings of Embodiment 1 of the invention.

Here, details of the configuration in which the aligning direction of the nozzle openings 21 constituting the nozzle row of the head main body 110 is inclined with respect to the X direction as the transporting direction of the recording sheet S will be described with reference to FIGS. 5 and 9. FIG. 9 is a schematic view explaining the arrangement of the nozzle openings of the head main body according to this embodiment.

The plurality of the head main bodies 110 are fixed in a state where, in the in-plane direction of the liquid ejection surface 20*a*, the nozzle rows a and b are inclined with respect to the X direction as the transporting direction of the recording sheet S. The nozzle row referred to in this case is a row of a plurality of nozzle openings 21 aligned in a predetermined direction. In this embodiment, two rows which are the nozzle rows a and b, each of which is constituted of a plurality of nozzle openings 21 aligned in the Xa direction as the predetermined direction, are provided in the liquid ejection surface 20*a*. The Xa direction intersects the X direction at an angle greater than 0° and less than 90°. In this case, it is preferable that the Xa direction intersect the X direction at an angle greater than 0° and less than 45°. In this case, upon comparison with in the case where the Xa direction intersects the X direction at an angle greater than 45° and less than 90°, a gap D1 between adjacent nozzle openings 21 in the Y direction can be further reduced. As a result, the recording head 100 can have high definition in the Y direction. Needless to say, the Xa direction may intersect the X direction at an angle greater than 45° and less than 90°.

The meaning of "the Xa direction intersects the X direction at the angle greater than 0° and less than 45°" implies that, in the plane of the liquid ejection surface 20*a*, the nozzle row is inclined closer to the X direction than a straight line intersecting the X direction at 45°. The gap D1 referred to in this case is a gap between the nozzle openings 21 of the nozzle rows a and b, in a state where the nozzle openings 21 are projected in the X direction, with respect to an imaginary line in the Y direction. Furthermore, a gap between the nozzle openings 21 of the nozzle rows a and b which are projected in the Y direction, with respect to an imaginary line in the X direction, is set to a gap D2.

In this embodiment, liquids of two kinds can be ejected from one nozzle row and liquids of four kinds can be ejected from two nozzle rows, as illustrated in FIG. 9. In other words, when it is assumed that inks of four colors are used, a black ink Bk and a magenta ink M are can be ejected from the nozzle row a and a cyan ink C and a yellow ink Y can be ejected from the nozzle row b. Furthermore, the nozzle row a and the nozzle row b have the same number of nozzle openings 21. The Y-direction positions of the nozzle openings 21 of the nozzle row a and the Y-direction positions of the nozzle openings 21 of the nozzle row b overlap in the X direction.

Head main bodies 110*a* to 110*c* have the nozzle rows a and b. The head main bodies 110*a* to 110*b* are arranged close to each other in the Y direction, and thus the nozzle openings 21 of adjacent head main bodies 110 in the Y direction are aligned in a state where the nozzle openings 21 overlap in the X direction. Accordingly, a part of the nozzle row a of the head main body 110*a*, which is a portion ejecting the magenta ink M, and a part of the nozzle row b of the head main body 110*a*, which is a portion ejecting the yellow ink Y, overlap, in the X direction, with a part of the nozzle row a of the head main body 110*b*, which is a portion ejecting the black ink Bk, and a part of the nozzle row b of the head main body 110*b*, which is a portion ejecting the cyan ink C. Therefore, lines of four colors are aligned in one row in the X direction, and thus a color image can be printed. Similarly, in the case of adjacent head main bodies 110*b* and 110*c* in the Y direction, the nozzle openings 21 are aligned in a state where the nozzle openings 21 overlap in the X direction.

At least some of nozzle openings 21 of nozzle rows of adjacent head main bodies 110, which are the nozzle rows ejecting ink of the same color, overlap in the X direction. As a result, the image quality in a joining portion between the head main bodies 110 can be improved. In other words, one nozzle opening 21 of the nozzle row a of the head main body 110*a*, which is the nozzle row ejecting the magenta ink M, and one nozzle opening 21 of the nozzle row a of the head main body 110*b*, which is the nozzle row ejecting the magenta ink M, overlap in the X direction. Ejection operations through the two overlapping nozzle openings 21 are controlled, in such a manner that image quality deterioration, such as banding and streaks, can be prevented from occurring in the joining portion between the adjacent head main bodies 110. In an example illustrated in FIG. 9, only one nozzle opening 21 of one head main body 110 and one nozzle openings 21 of the other head main body 110 overlap in the X direction. However, two or more nozzle openings 21 of one head main body 110 and two or more nozzle openings 21 of the other head main body 110 may overlap in the X direction.

Needless to say, the arrangement relating to colors may not be limited thereto. Although not particularly illustrated, the black ink Bk, the magenta ink M, the cyan ink C, and the yellow ink Y can be ejected from, for example, one nozzle row.

As described above, the head unit 101 is constituted by fixing four recording heads 100 to the head fixing substrate 102, in which each recording head 100 has a plurality of head main bodies 110. Parts of nozzle rows of adjacent recording heads 100 overlap in the X direction, as illustrated by a straight line G in FIG. 5. In other words, similarly to the relationship between adjacent head main bodies 110 in one recording head 100, adjacent head main bodies 110 of adjacent recording heads 100 in the Y direction are arranged close to each other in the Y direction, and thus a color image can be printed in a portion between the adjacent recording heads 100 and, further, the image quality in the joining portion between the adjacent recording heads 100 can be improved. Needless to say, the number of overlapping nozzle openings 21 between adjacent recording heads 100, which overlap in the X direction, is not necessarily the same as the number of overlapping nozzle openings 21 between adjacent head main bodies 110 in one recording head 100, which overlap in the X direction.

As described above, the nozzle rows between adjacent head main bodies 110 and the nozzle rows between adjacent recording heads 100 partially overlap in the X direction, and thus the image quality in the joining portion can be improved.

It is preferable that, in a portion between nozzle openings 21 of nozzle rows, which are adjacent in the Xa direction, a pitch between adjacent nozzles and the an angle between the X direction and the Xa direction be set to satisfy a condition in which the relationship between the gap D1 in the X direction and the gap D2 in the Y direction satisfies an integer ratio. In this case, when an image is printed in accordance with image data which is constituted of pixels having a matrix shape in which the pixels are arranged in both the X direction and the Y direction, it is easy to pair each nozzle with each pixel. Needless to say, the relationship is not limited to the relationship of an integer ratio.

In a plan view seen from the liquid ejection surface 20*a* side, the recording head 100 of this embodiment has a substantially parallelogram shape, as illustrated in FIG. 5. The reason for this is as follows. The Xa direction as the aligning direction of the nozzle openings 21 which constitute the nozzle rows a and b of each head main body 110 is inclined with respect to the X direction as the transporting direction of the recording sheet S. Furthermore, the appearance of the recording head 100 is formed in a shape parallel to the Xa direction as an inclined direction of the nozzle row b. In other words, the fixing plate 130 has a substantially parallelogram shape. Needless to say, in a plan view seen from the liquid ejection surface 20*a* side, the shape of the recording head 100 is not limited to a substantially parallelogram. The recording head 100 may have a trapezoidal-rectangular shape, a polygonal shape, or the like.

An example in which two nozzle rows are provided in one head main body is described in the embodiment described above. However, needless to say, even when three or more nozzle rows are provided, the same effects described above may be obtained. Furthermore, when two nozzle rows are provided in one head main body 110, as in the case of this embodiment, nozzle openings 21 of the two nozzle rows can be arranged in a portion between two manifolds 95 respectively corresponding to the two nozzle rows, as illustrated in FIG. 7. Thus, a gap between the two nozzle rows in the Ya direction can be reduced, compared to in the case where nozzle openings 21 of a plurality of nozzle rows are arranged on the same side with respect to manifolds respectively corresponding to the plurality of nozzle rows. As a result, in the nozzle plate 20, the area necessary for providing two nozzle rows can be reduced. In addition, it is easy to connect the respective piezoelectric actuators 300 corresponding to two nozzle rows and the respective COF substrates 98.

In this embodiment, the nozzle row a and the nozzle row b have the same number of nozzle openings 21. Accordingly, in the nozzle rows, the same number of nozzle openings 21 can overlap in the X direction, and thus it is possible to effectively eject liquid. However, nozzle rows do not have necessarily the same number of nozzle openings. Furthermore, the nozzle rows a and b may eject liquids of the same kind. In other words, the nozzle rows a and b may eject, for example, ink of the same color.

In this embodiment, it is preferable that the head main body 110 have s nozzle plate 20 having two nozzle rows. In this case, nozzle rows can be arranged with more high precision. Needless to say, one nozzle row may be provided in each nozzle plate 20. The nozzle plate 20 is constituted of a stainless-steel (SUS) plate, a silicon substrate, or the like.

Figure 10:
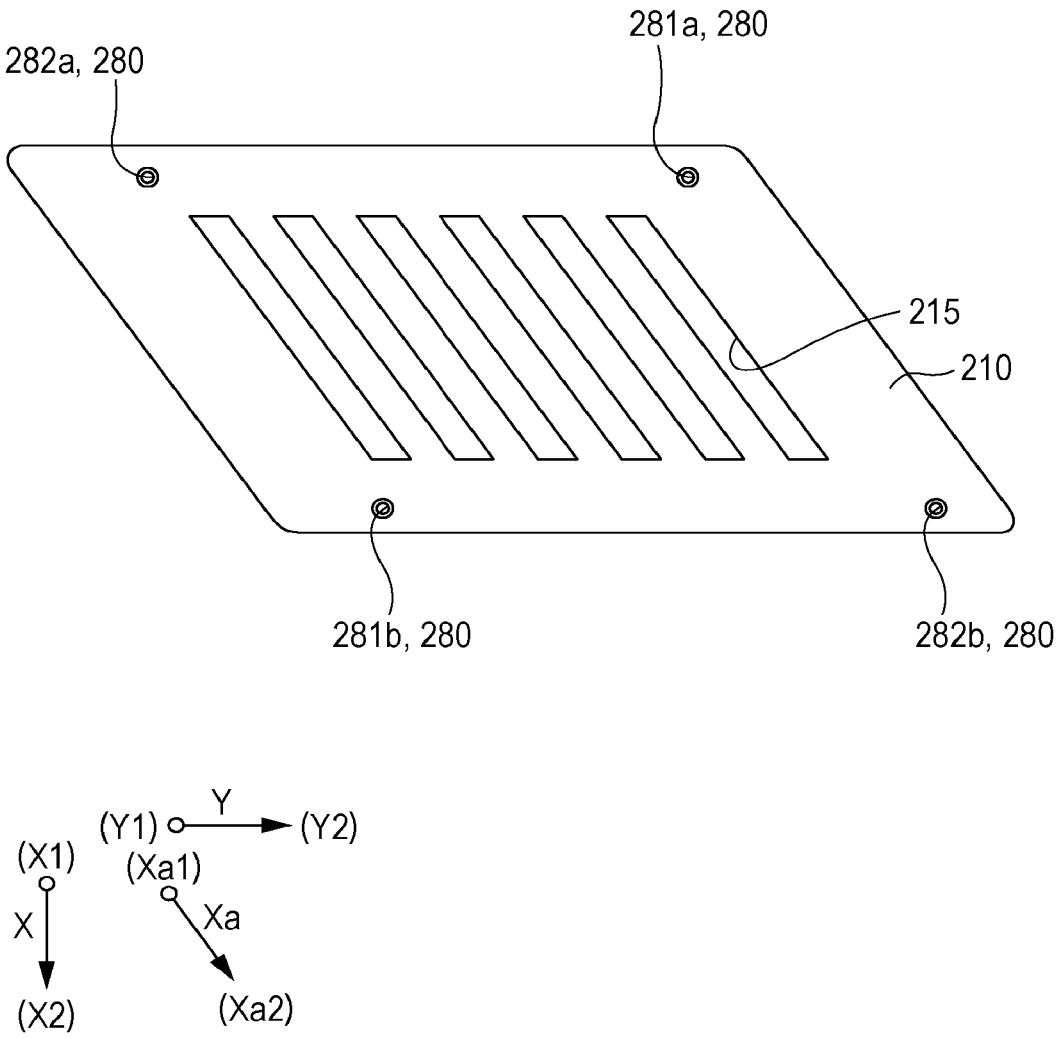
FIG. 10 is a plan view of a flow-path member (which is a first flow-path member) according to Embodiment 1 of the invention.
Figure 11:
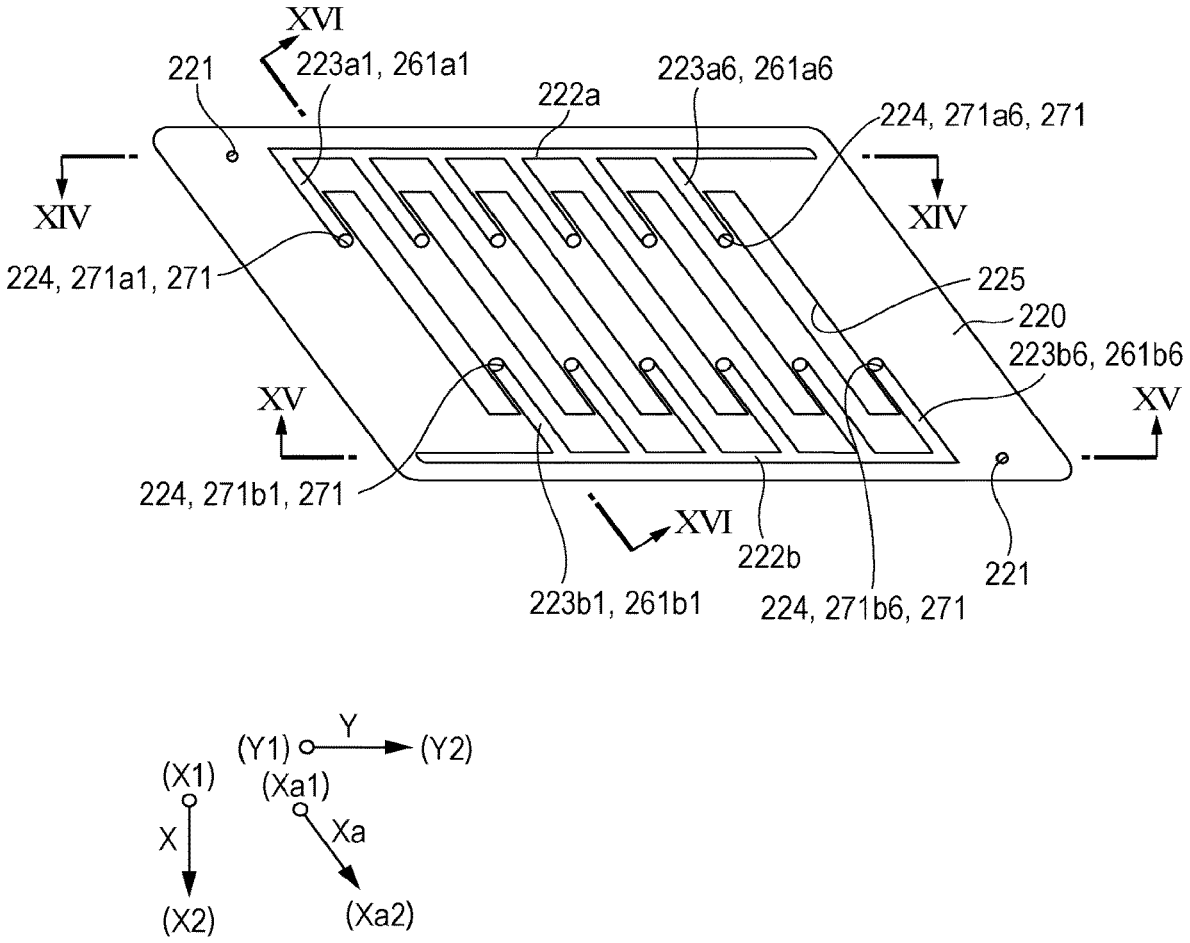
FIG. 11 is a plan view of a second flow-path member according to Embodiment 1 of the invention.
Figure 12:
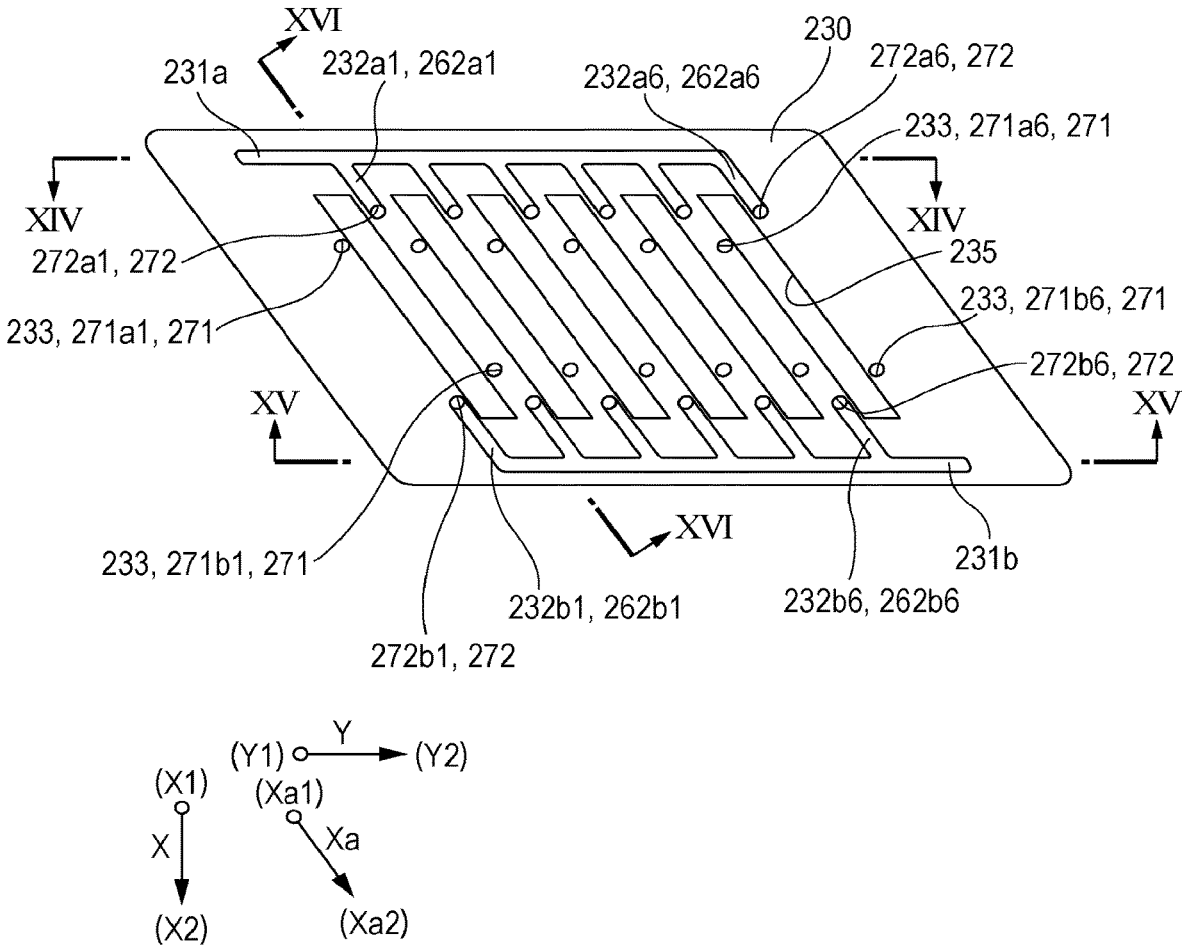
FIG. 12 is a plan view of a third flow-path member according to Embodiment 1 of the invention.
Figure 13:
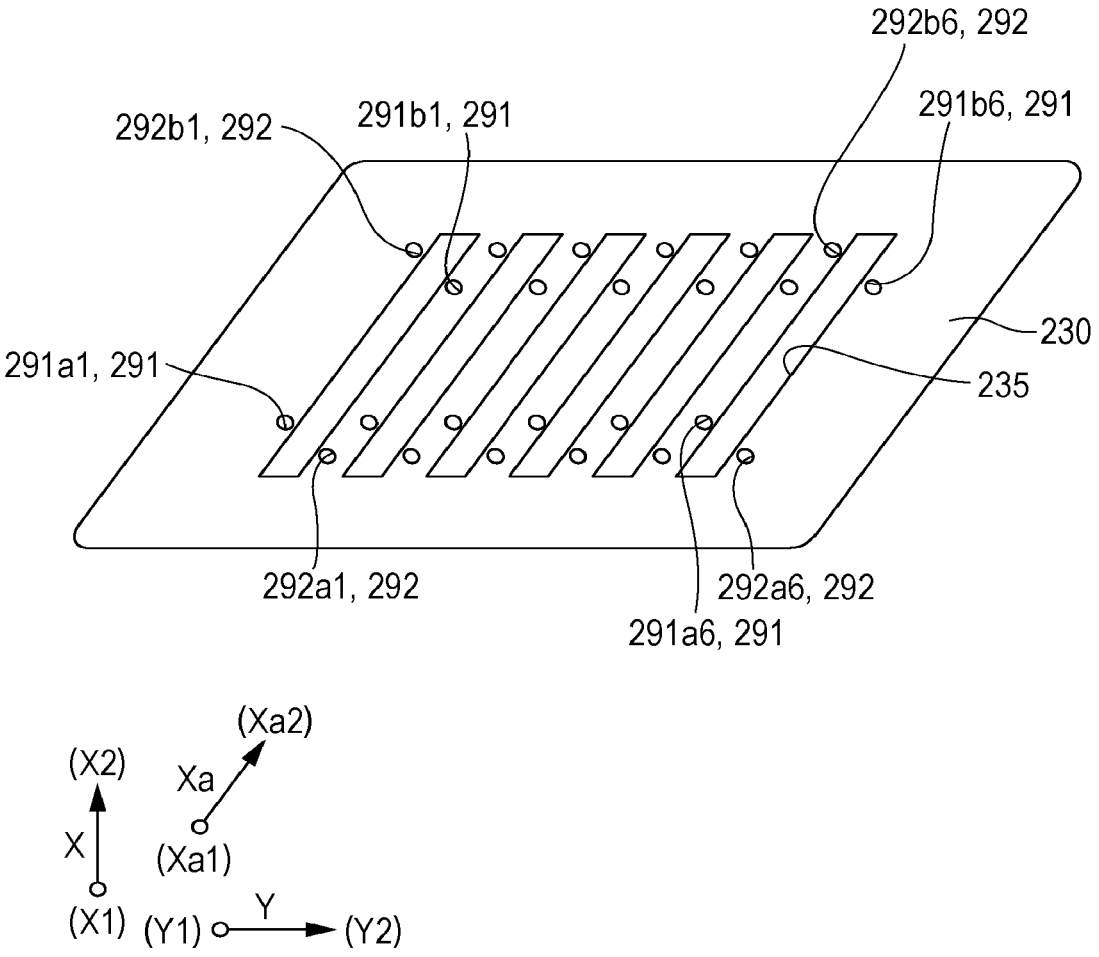
FIG. 13 is a bottom view of the third flow-path member according to Embodiment 1 of the invention.
Figure 14:
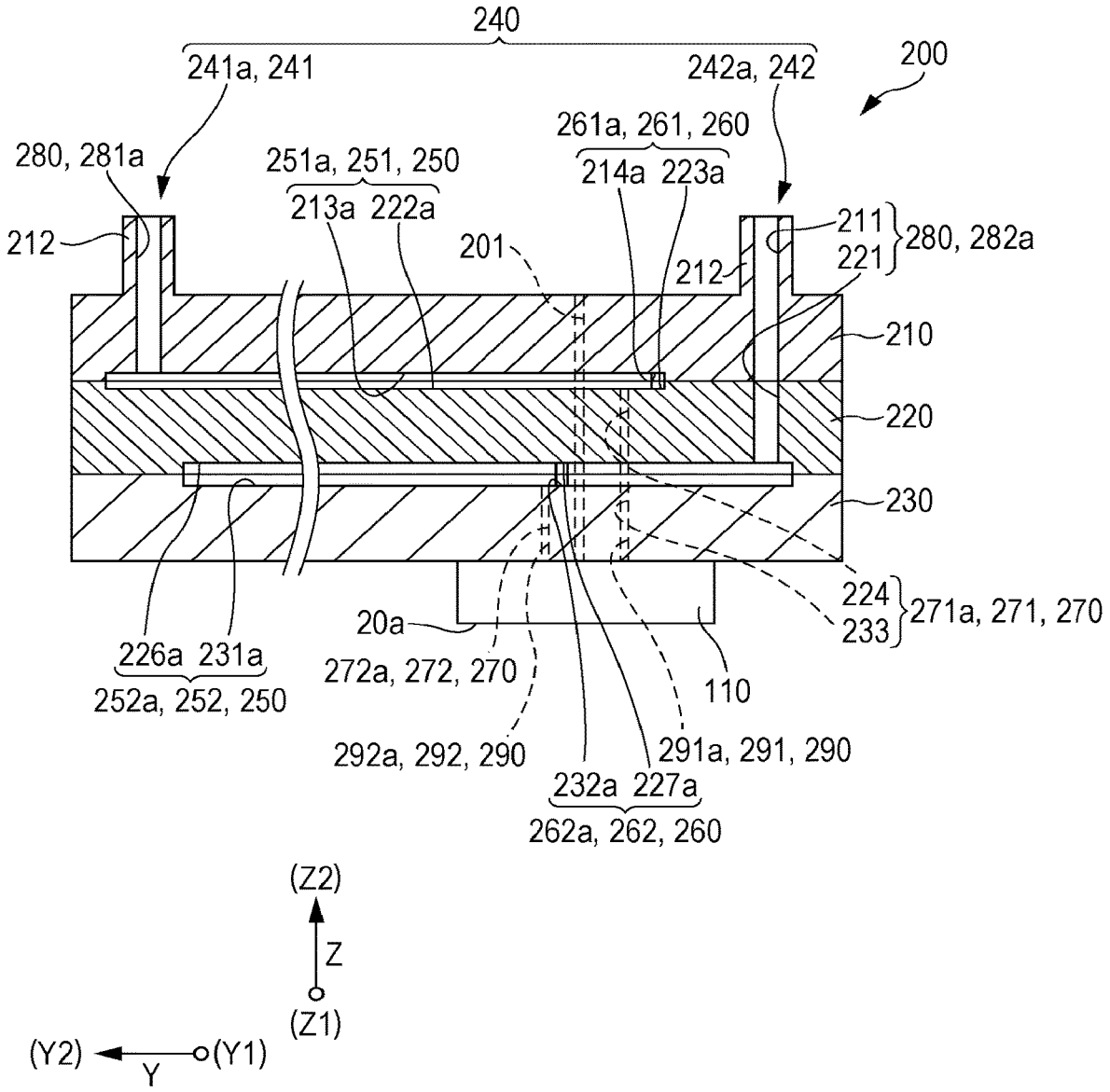
FIG. 14 is a cross-sectional view of FIGS. 11 and 12, taken along line XIV-XIV.
Figure 15:
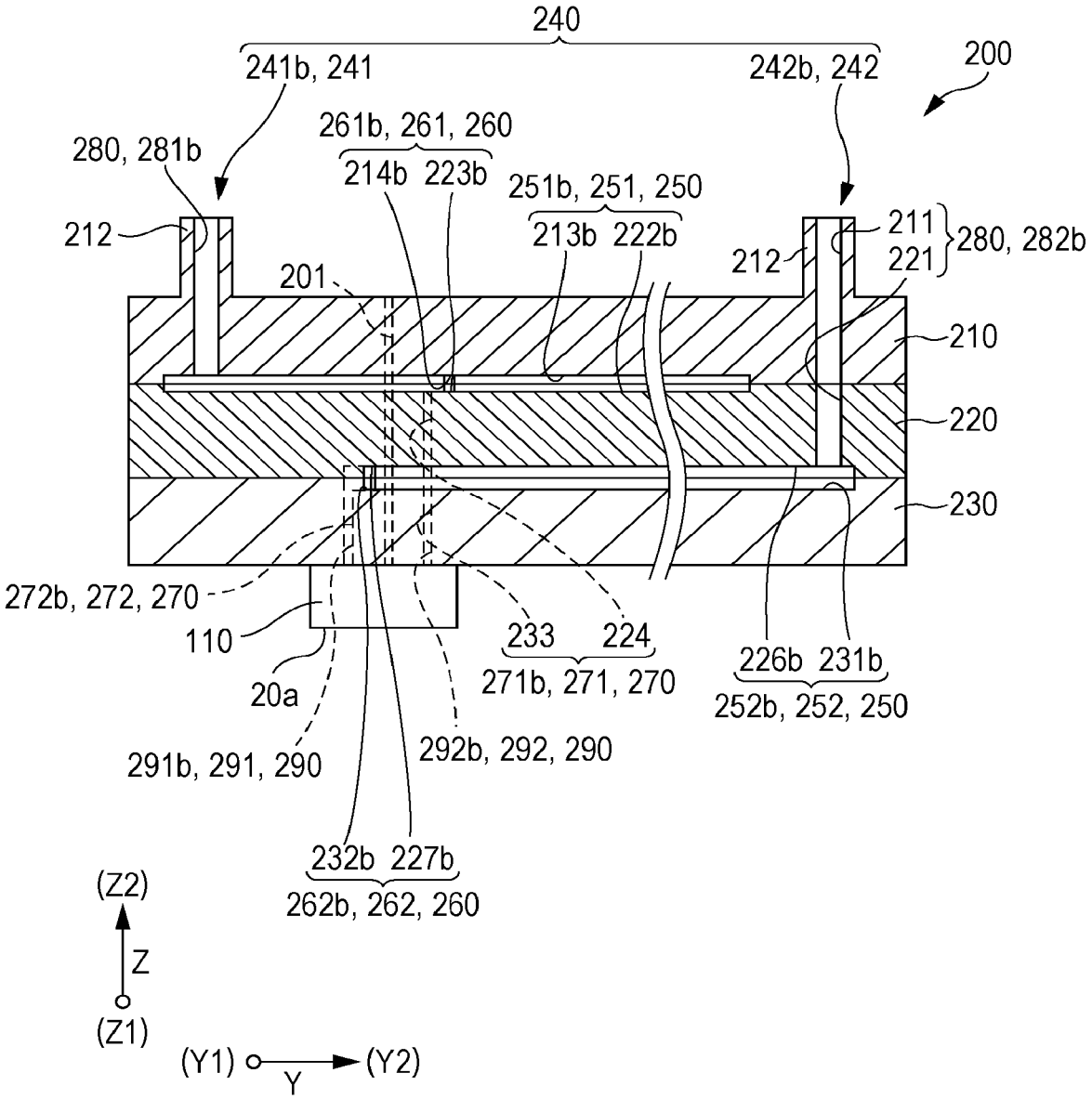
FIG. 15 is a cross-sectional view of FIGS. 11 and 12, taken along line XV-XV.
Figure 16:
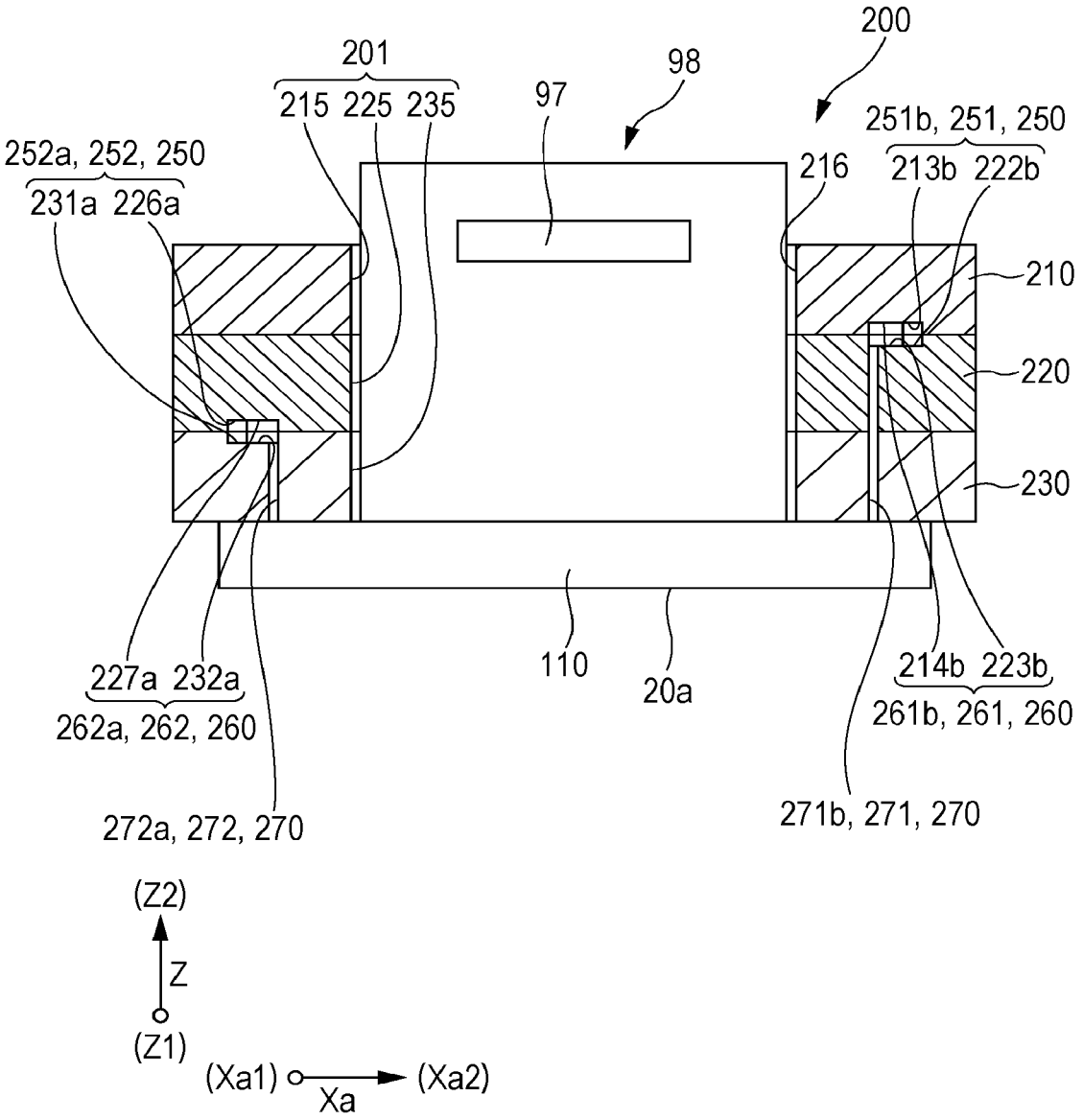
FIG. 16 is a cross-sectional view of FIGS. 11 and 12, taken along line XVI-XVI.

Details of the flow-path member 200 according to this embodiment will be described with reference to FIGS. 10 to 16. FIG. 10 is a plan view of a first flow-path member 210 as the flow-path member 200, FIG. 11 is a plan view of a second flow-path member 220 as the flow-path member 200, and FIG. 12 is a plan view of a third flow-path member 230 as the flow-path member 200. FIG. 13 is a bottom view of the third flow-path member 230. FIG. 14 is a cross-sectional view of FIGS. 11 and 12, taken along a line XIV-XIV, and FIG. 15 is a cross-sectional view of FIGS. 11 and 12, taken along a line XV-XV. FIG. 16 is a cross-sectional view of FIGS. 11 and 12, taken along a line XVI-XVI. FIGS. 10 to 12 are plan views seen from the Z2 side and FIG. 13 is a bottom view seen from the Z1 side.

A flow path 240 through which ink flows is provided in the flow-path member 200. In the flow-path member 200 of this embodiment, the flow-path member 200 includes three flow-path members stacked in the Z direction and a plurality of flow paths 240. The three flow-path members are a first flow-path member 210, a second flow-path member 220, and a third flow-path member 230. In the Z direction, the first flow-path member 210, the second flow-path member 220, and the third flow-path member 230 are stacked in order from the holding member 120 side (see FIG. 2) to the head main body 110 side. Although not particularly illustrated, the first flow-path member 210, the second flow-path member 220, and the third flow-path member 230 are fixed in an adhesive manner, using an adhesive. However, the configuration is not limited thereto. The first flow-path member 210, the second flow-path member 220, and the third flow-path member 230 may be fixed to each other, using a fixing unit, such as a screw. Furthermore, although the material forming the flow-path member is not particularly limited, the flow-path member can be constituted of, for example, metal, such as SUS, or resin.

In the flow path 240, one end is an introduction flow path 280 and the other end is a connection portion 290. Ink supplied from a member (which is the holding member 120, in this embodiment) upstream from the flow path 240 is introduced through the introduction flow path 280. The connection portion 290 functions as an output port through which the ink is supplied to the head. In this embodiment, four flow paths 240 are provided. In each flow path 240, ink is supplied to one introduction flow path 280. In the middle of each flow path 240, the flow path 240 branches into a plurality of flow paths. Therefore, in each flow path 240, the ink is supplied to the head main body 110 through a plurality of connection portions 290.

Some of the four flow paths 240 are first flow paths 241 and the others are second flow paths 242. In this embodiment, two first flow paths 241 and two second flow paths 242 are provided. One of the two first flow paths 241 is referred to as a first flow path 241*a* and the other is referred to as a first flow path 241*b*. Hereinafter, the first flow path 241 indicates both the first flow path 241*a* and the first flow path 241*b*. The second flow path 242 has a similar configuration.

The first flow path 241 includes a first introduction flow path 281. The first introduction flow path 281 connects a first flow path portion 251 of the first flow path 241 and a flow path (which is the flow path of the holding member 120, in this embodiment) upstream from the flow-path member 200. The first flow path portion 251 will be described below. In this embodiment, each of two first flow paths 241*a* and 241*b* has a first introduction flow path 281*a* and a first introduction flow path 281*b*.

Specifically, the first introduction flow path 281*a* is a through-hole which is open at the top surface of a protrusion portion 212 which is provided on the Z2-side surface of the first flow-path member 210. The through-hole passes through the first flow-path member 210 in the Z direction. The first introduction flow path 281*b* has a similar configuration. Hereinafter, the first introduction flow path 281 indicates both the first introduction flow path 281*a* and the first introduction flow path 281*b*.

The second flow path 242 includes a second introduction flow path 282. The second introduction flow path 282 connects a second flow path portion 252 of the second flow path 242 and a flow path (which is the flow path of the holding member 120, in this embodiment) upstream from the flow-path member 200. The second flow path portion 252 will be described below. In this embodiment, each of two second flow paths 242*a* and 242*b* has a second introduction flow path 282*a* and a second introduction flow path 282*b*.

Specifically, the second introduction flow path 282*a* is constituted of a through-hole 211 and a through-hole 221 which communicate with each other. The through-hole 211 is open at the top surface of a protrusion portion 212 which is provided on the Z2-side surface of the first flow-path member 210 and the through-hole 211 passes through, in the Z direction, both the first flow-path member 210 and the protrusion portion 212. The through-hole 221 passes through the second flow-path member 220 in the Z direction. The second introduction flow path 282*b* has a similar configuration. Hereinafter, the second introduction flow path 282 indicates both the second introduction flow path 282*a* and the second introduction flow path 282*b*.

The introduction flow path 280 indicates all of the four introduction flow paths described above.

In this embodiment, in a plan view illustrated in FIG. 10, the first introduction flow path 281*a* is disposed in the vicinity of an upper right corner of the first flow-path member 210 and the first introduction flow path 281*b* is disposed in the vicinity of a lower left corner of the first flow-path member 210. In the plan view illustrated in FIG. 10, the second introduction flow path 282*a* is disposed in the vicinity of an upper left corner of the first flow-path member 210 and the second introduction flow path 282*b* is disposed in the vicinity of a lower right corner of the first flow-path member 210.

The first flow path 241 includes the first flow path portion 251 which is formed by both the first flow-path member 210 and the second flow-path member 220. The first flow path portion 251 is a part of the first flow path 241, through which ink flows in a direction parallel to the liquid ejection surface 20*a*. In this embodiment, two first flow paths 241 are formed, and thus two first flow path portions 251 are formed. One of the two first flow path portions 251 is referred to as a first flow path portion 251*a* and the other is referred to as a first flow path portion 251*b*.

A common groove portion 213*a* and a common groove portion 222*a* are matched and sealed, in such a manner that the first flow path portion 251*a* is formed. The common groove portion 213*a* is formed on the Z1-side surface of the first flow-path member 210 and extends in the Y direction. The common groove portion 222*a* is formed on the Z2-side surface of the second flow-path member 220 and extends in the Y direction. A common groove portion 213*b* and a common groove portion 222*b* are matched and sealed, in such a manner that the first flow path portion 251*b* is formed. The common groove portion 213*b* is formed on the Z1-side surface of the first flow-path member 210 and extends in the Y direction. The common groove portion 222*b* is formed on the Z2-side surface of the second flow-path member 220 and extends in the Y direction.

The first flow path portion 251*a* is constituted of both the common groove portion 213*a* in the first flow-path member 210 and the common groove portion 222*a* in the second flow-path member 220 and the first flow path portion 251*b* are constituted of both the common groove portion 213*b* in the first flow-path member 210 and the common groove portion 222*b* in the second flow-path member 220. As a result, the cross-sectional area of the first flow path portion 251 is widened, and thus pressure losses in the first flow path portion 251 are reduced. The first flow path portion 251 may be constituted of the common groove portions 213*a* and 213*b* which are formed in only the first flow-path member 210 and the Z2-side surface of the second flow-path member 220. Alternatively, the first flow path portion 251 may be constituted of the common groove portions 222*a* and 222*b* which are formed in only the second flow-path member 220 and the Z1-side surface of the first flow-path member 210.

The first flow path portion 251*a* and the first flow path portion 251*b* are disposed in both areas located X-directionally outside the opening portion 201 (in other words, a second opening portion 225) through which the COF substrate 98 is inserted.

The second flow path 242 includes the second flow path portion 252 which is formed by both the second flow-path member 220 and the third flow-path member 230. The second flow path portion 252 is a part of the second flow path 242, through which ink flows in a direction parallel to the liquid ejection surface 20*a*. In this embodiment, two second flow paths 242 are formed, and thus two second flow path portions 252 are formed. One of the two second flow path portions 252 is referred to as a second flow path portion 252*a* and the other is referred to as a second flow path portion 252*b*.

A common groove portion 226*a* and a common groove portion 231*a* are matched and sealed, in such a manner that the second flow path portion 252*a* is formed. The common groove portion 226*a* is formed on the Z1-side surface of the second flow-path member 220 and extends in the Y direction. The common groove portion 231*a* is formed on the Z2-side surface of the third flow-path member 230 and extends in the Y direction. A common groove portion 226*b* and a common groove portion 231*b* are matched and sealed, in such a manner that the second flow path portion 252*b* is formed. The common groove portion 226*b* is formed on the Z1-side surface of the second flow-path member 220 and extends in the Y direction. The common groove portion 231*b* is formed on the Z2-side surface of the third flow-path member 230 and extends in the Y direction.

The second flow path portion 252*a* is constituted of both the common groove portion 226*a* in the second flow-path member 220 and the common groove portion 231*a* in the third flow-path member 230 and the second flow path portion 252*b* is constituted of both the common groove portion 226*b* in the second flow-path member 220 and the common groove portion 231*b* in the third flow-path member 230. As a result, the cross-sectional area of the second flow path portion 252 is widened, and thus pressure losses in the second flow path portion 252 are reduced. The second flow path portion 252 may be constituted of the common groove portions 226*a* and 226*b* which are formed in only the second flow-path member 220 and the Z2-side surface of the third flow-path member 230. Alternatively, the second flow path portion 252 may be constituted of the common groove portions 231*a* and 231*b* which are formed in only the third flow-path member 230 and the Z1-side surface of the second flow-path member 220.

The second flow path portion 252*a* and the second flow path portion 252*b* are disposed in both areas located X-directionally outside the opening portion 201 (in other words, a third opening portion 235) through which the COF substrate 98 is inserted.

Hereinafter, the first flow path portion 251 indicates both the first flow path portion 251*a* and the first flow path portion 251*b*. Furthermore, the second flow path portion 252 indicates both the second flow path portion 252*a* and second flow path portion 252*b*. In addition, the flow path portion 250 indicates all of the four flow path portions described above.

In the first flow path 241 of this embodiment, one introduction flow path 280 branches into a plurality of connection portions 290. In other words, the first flow path portion 251 branches into a plurality of first bifurcation flow path portions 261, in the same surface with the first flow path portion 251. A surface in which the plurality of first bifurcation flow path portions 261 and the first flow path portion 251 are formed corresponds to a first flow-path forming surface of the invention. In this embodiment, the surface is a boundary surface in which the first flow-path member 210 and the second flow-path member 220 are bonded to each other. The surface is parallel to the liquid ejection surface 20*a*.

In this embodiment, the first flow path portion 251 branches into six first bifurcation flow path portions 261, in the first flow-path forming surface parallel to the liquid ejection surface 20*a*. The six first bifurcation flow path portions 261 branching off from the first flow path portion 251*a* are respectively referred to as first bifurcation flow path portions 261*a*1 to 261*a*6.

Similarly, six first bifurcation flow path portions 261 branching off from the first flow path portion 251*b* are respectively referred to as first bifurcation flow path portions 261*b*1 to 261*b*6.

Hereinafter, the first bifurcation flow path portion 261*a* indicates all of the six bifurcation flow path portions connected to the first flow path portion 251*a*. The first bifurcation flow path portion 261*b* indicates all of the six bifurcation flow path portions connected to the first flow path portion 251*b*. In addition, the first bifurcation flow path portion 261 indicates all of the twelve bifurcation flow path portions connected to the first flow path portions 251*a* and 251*b*.

Reference letters and numerals corresponding to the first bifurcation flow path portions 261*a*2 to 261*a*5 of the six first bifurcation flow path portions 261*a*1 to 261*a*6 aligned in the Y direction are omitted in the accompanying drawings. However, it is assumed that the first bifurcation flow path portions 261*a*2 to 261*a*5 are aligned in order from the Y1 side to the Y2 side. The first bifurcation flow path portions 261*b*1 to 261*b*6 have a similar configuration to that described above.

Specifically, a plurality of branch groove portions 214*a* which communicate with the common groove portion 213*a* and extend to the opening portion 201 side are provided in the Z1-side surface of the first flow-path member 210. A plurality of branch groove portions 223*a* which communicate with the common groove portion 222*a* and extend to the opening portion 201 side are provided in the Z2-side surface of the second flow-path member 220. The branch groove portion 214*a* and the branch groove portion 223*a* are sealed in a state where the branch groove portion 214*a* and the branch groove portion 223*a* face to each other, in such a manner that the first bifurcation flow path portion 261*a* is formed.

A plurality of branch groove portions 214*b* which communicate with the common groove portion 213*b* and extend to the opening portion 201 side are provided in the Z1-side surface of the first flow-path member 210. A plurality of branch groove portions 223*b* which communicate with the common groove portion 222*b* and extend to the opening portion 201 side are provided in the Z2-side surface of the second flow-path member 220. The branch groove portion 214*b* and the branch groove portion 223*b* are sealed in a state where the branch groove portion 214*b* and the branch groove portion 223*b* face to each other, in such a manner that the first bifurcation flow path portion 261*b* is formed.

The first bifurcation flow path portion 261*a* is constituted of both the branch groove portion 214*a* in the first flow-path member 210 and the branch groove portion 223*a* in the second flow-path member 220 and the first bifurcation flow path portion 261*b* is constituted of both the branch groove portion 214*b* in the first flow-path member 210 and the branch groove portion 223*b* in the second flow-path member 220. As a result, the cross-sectional area of the first bifurcation flow path portion 261 is widened, and thus pressure losses in the first bifurcation flow path portion 261 are reduced. The first bifurcation flow path portion 261 may be constituted of the branch groove portions 214*a* and 214*b* which are formed in only the first flow-path member 210 and the Z2-side surface of the second flow-path member 220. Alternatively, the first bifurcation flow path portion 261 may be constituted of the branch groove portions 223*a* and 223*b* which are formed in only the second flow-path member 220 and the Z1-side surface of the first flow-path member 210.

In the second flow path 242 of this embodiment, one introduction flow path 280 branches into a plurality of connection portions 290. In other words, the second flow path portion 252 branches into a plurality of second bifurcation flow path portions 262, in the same surface with the second flow path portion 252. A surface in which the plurality of second bifurcation flow path portions 262 and the second flow path portion 252 are formed corresponds to a second flow-path forming surface of the invention. In this embodiment, the surface is a boundary surface in which the second flow-path member 220 and the third flow-path member 230 are bonded to each other. The surface is parallel to the liquid ejection surface 20*a*.

In this embodiment, the second flow path portion 252 branches into six second bifurcation flow path portions 262, in the second flow-path forming surface parallel to the liquid ejection surface 20*a*. The six second bifurcation flow path portions 262 branching off from the second flow path portion 252*a* are respectively referred to as second bifurcation flow path portions 262*a*1 to 262*a*6. Hereinafter, the second bifurcation flow path portion 262*a* indicates all of the six bifurcation flow path portions connected to the second flow path portion 252*a*.

Similarly, the six second bifurcation flow path portions 262 branching off from the second flow path portion 252*b* are respectively referred to as second bifurcation flow path portions 262*b*1 to 262*b*6. Hereinafter, the second bifurcation flow path portion 262*b* indicates all of the six bifurcation flow path portions connected to the second flow path portion 252*b*. Furthermore, the second bifurcation flow path portion 262 indicates all of the twelve bifurcation flow path portions connected to the second flow path portions 252*a* and 252*b*. In addition, the bifurcation flow path portion 260 indicates all of the twenty-four bifurcation flow path portions described above.

Reference letters and numerals corresponding to the second bifurcation flow path portions 262*a*2 to 262*a*5 of the six second bifurcation flow path portions 262*a*1 to 262*a*6 aligned in the Y direction are omitted in the accompanying drawings. However, it is assumed that the second bifurcation flow path portions 262*a*2 to 262*a*5 are aligned in order from the Y1 side to the Y2 side. The second bifurcation flow path portions 262*b*1 to 262*b*6 have a similar configuration to that described above.

Specifically, a plurality of branch groove portions 227*a* which communicate with the common groove portion 226*a* and extend to the opening portion 201 side are provided in the Z1-side surface of the second flow-path member 220. A plurality of branch groove portions 232*a* which communicate with the common groove portion 231*a* and extend to the opening portion 201 side are provided in the Z2-side surface of the third flow-path member 230. The branch groove portion 227*a* and the branch groove portion 232*a* are sealed in a state where the branch groove portion 227*a* and the branch groove portion 232*a* face each other, in such a manner that the second bifurcation flow path portion 262*a* is formed.

A plurality of branch groove portions 227*b* which communicate with the common groove portion 226*b* and extend to the opening portion 201 side are provided in the Z1-side surface of the second flow-path member 220. A plurality of branch groove portions 232*b* which communicate with the common groove portion 231*b* and extend to the opening portion 201 side are provided in the Z2-side surface of the third flow-path member 230. The branch groove portion 227*b* and the branch groove portion 232*b* are sealed in a state where the branch groove portion 227*b* and the branch groove portion 232*b* face each other, in such a manner that the second bifurcation flow path portion 262*b* is formed.

The second bifurcation flow path portion 262*a* is constituted of both the branch groove portion 227*a* in the second flow-path member 220 and the branch groove portion 232*a* in the third flow-path member 230 and the second bifurcation flow path portion 262*b* is constituted of both the branch groove portion 227*b* in the second flow-path member 220 and the branch groove portion 232*b* in the third flow-path member 230. As a result, the cross-sectional area of the second bifurcation flow path portion 262 is widened, and thus pressure losses in the second bifurcation flow path portion 262 are reduced. The second bifurcation flow path portion 262 may be constituted of the branch groove portions 227*a* and 227*b* which are formed in only the second flow-path member 220 and the Z2-side surface of the third flow-path member 230. Alternatively, the second bifurcation flow path portion 262 may be constituted of the branch groove portions 232*a* and 232*b* which are formed in only the third flow-path member 230 and the Z1-side surface of the second flow-path member 220.

An end portion of the first bifurcation flow path portion 261, which is the end portion on a side opposite to the first flow path portion 251, is connected to a first vertical flow path 271. Specifically, a through-hole 224 is provided in the second flow-path member 220. The through-hole 224 passes through the second flow-path member 220 in the Z direction. In addition, a through-hole 233 is provided in the third flow-path member 230. The through-hole 233 passes through the third flow-path member 230 in the Z direction. The through-hole 224 and the through-hole 233 communicate with each other and form the first vertical flow path 271.

In this embodiment, the first vertical flow paths 271 are connected to the respective first bifurcation flow path portions 261*a*1 to 261*a*6 and 261*b*1 to 261*b*6. The recording head 100 includes the twelve first vertical flow paths 271*a*1 to 271*a*6 and 271*b*1 to 271*b*6.

Similarly, an end portion of the second bifurcation flow path portion 262, which is the end portion on a side opposite to the second flow path portion 252, is connected to a second vertical flow path 272. Specifically, the second vertical flow path 272 is provided, as a through-hole, in the third flow-path member 230. The through-hole passes through the third flow-path member 230 in the Z direction.

In this embodiment, the second vertical flow paths 272 are connected to the respective second bifurcation flow path portions 262*a*1 to 262*a*6 and 262*b*1 to 262*b*6. The recording head 100 includes the twelve second vertical flow paths 272*a*1 to 272*a*6 and 272*b*1 to 272*b*6.

Hereinafter, a first vertical flow path 271*a* indicates the first vertical flow paths 271*a*1 to 271*a*6. A first vertical flow path 271*b* indicates the first vertical flow paths 271*b*1 to 271*b*6. The first vertical flow path 271 indicates all of the first vertical flow path 271*a* and the first vertical flow path 271*b*.

Similarly, a second vertical flow path 272*a* indicates the second vertical flow paths 272*a*1 to 272*a*6. A second vertical flow path 272*b* indicates the second vertical flow paths

272*b*1 to 272*b*6. The second vertical flow path 272 indicates all of the second vertical flow paths 272*a* and the second vertical flow paths 272*b*.

Furthermore, a vertical flow path 270 indicates all of the twenty-four vertical flow paths described above.

Reference letters and numerals corresponding to the first vertical flow paths 271*a*2 to 271*a*5 of the six first vertical flow paths 271*a*1 to 271*a*6 aligned in the Y direction are omitted in the accompanying drawings. However, it is assumed that the first vertical flow paths 271*a*2 to 271*a*5 are aligned in order from the Y1 side to the Y2 side. The first vertical flow paths 271*b*1 to 271*b*6, the second vertical flow paths 272*a*1 to 272*a*6, and the second vertical flow paths 272*b*1 to 272*b*6 have a similar configuration described above.

The vertical flow path 270 described above has the connection portion 290 which is an opening on the Z1 side of the third flow-path member 230. The connection portion 290 communicates with the introduction path 44 provided in the head main body 110. Details of this will be described below.

In this embodiment, the first vertical flow paths 271*a*1 to 271*a*6 respectively have first connection portions 291*a*1 to 291*a*6 which are openings on the Z1 side of the third flow-path member 230. In addition, the first vertical flow paths 271*b*1 to 271*b*6 respectively have first connection portions 291*b*1 to 291*b*6 which are openings on the Z1 side of the third flow-path member 230. Similarly, the second vertical flow paths 272*a*1 to 272*a*6 respectively have second connection portions 292*a*1 to 292*a*6 which are openings on the Z1 side of the third flow-path member 230. In addition, the second vertical flow paths 272*b*1 to 272*b*6 respectively have second connection portions 292*b*1 to 292*b*6 which are openings on the Z1 side of the third flow-path member 230.

The first connection portion 291*a*1, the first connection portion 291*b*1, the second connection portion 292*a*1, and the second connection portion 292*b*1 are connected to one of the six head main bodies 110. The first connection portions 291*a*2 to 291*a*6, the first connection portions 291*b*2 to 291*b*6, the second connection portions 292*a*2 to 292*a*6, and the second connection portions 292*b*2 to 292*b*6 have a similar configuration to that described above. In other words, the first flow path 241*a*, the first flow path 241*b*, the second flow path 242*a*, and the second flow path 242*b* are connected to one head main body 110.

Hereinafter, the first connection portion 291*a* indicates the first connection portions 291*a*1 to 291*a*6. The first connection portion 291*b* indicates the first connection portions 291*b*1 to 291*b*6. A first connection portion 291 indicates all of the first connection portions 291*a* and the first connection portions 291*b*.

Similarly, the second connection portion 292*a* indicates the second connection portions 292*a*1 to 292*a*6. The second connection portion 292*b* indicates the second connection portion 292*b*1 to 292*b*6. A second connection portion 292 indicates all of the second connection portions 292*a* and the second connection portions 292*b*.

Furthermore, a connection portion 290 indicates all of the twenty-four connection portions described above.

The flow-path member 200 according to this embodiment includes four flow paths 240, in other words, the first flow path 241*a*, the first flow path 241*b*, the second flow path 242*a*, and the second flow path 242*b*, as described above. In each flow path 240, a part extending from the introduction flow path 280 as an ink inlet port to a flow path portion 250 constitutes one flow path and the flow path portion 250 branches into bifurcation flow path portions 260. The bifurcation flow path portions 260 are connected to a plurality of head main bodies 110 via both the vertical flow paths 270 and the connection portions 290.

In this embodiment, a black ink Bk, a magenta ink M, a cyan ink C, and a yellow ink Y are used. The black ink Bk (in other words, a first liquid) is supplied from a liquid storage unit (not illustrated) to the first flow path 241*a* and the yellow ink Y (in other words, a first liquid) is supplied from a liquid storage unit to the first flow path 241*b*. The cyan ink C (in other words, a second liquid) is supplied from a liquid storage unit to the second flow path 242*a* and the magenta ink M (in other words, a second liquid) is supplied from a liquid storage unit to the second flow path 242*b*. The color inks respectively flow through the first flow path 241*a*, the first flow path 241*b*, the second flow path 242*a*, and the second flow path 242*b*, and then the color inks are supplied to the head main body 110. In this embodiment, the black ink Bk and the yellow ink Y as liquid supplied to the first flow path 241 correspond to the first liquid of the invention. The cyan ink C and the magenta ink M as liquid supplied to the second flow path 242 correspond to the second liquid of the invention.

In addition, the opening portion 201 is provided in the flow-path member 200. The COF substrate 98 provided in the head main body 110 is inserted through the opening portion 201. In this embodiment, the first opening portion 215 is provided in the first flow-path member 210. The first opening portion 215 passes through the first flow-path member 210 in the Z direction. The second opening portion 225 is provided in the second flow-path member 220. The second opening portion 225 passes through the second flow-path member 220 in the Z direction. The third opening portion 235 is provided in the third flow-path member 230. The third opening portion 235 passes through the third flow-path member 230 in the Z direction.

The first opening portion 215, the second opening portion 225, and the third opening portion 235 communicate with one another, in such a manner that one opening portion 201 is formed. The opening portion 201 has an opening shape extending in the Xa direction. Six opening portions 201 are aligned in the Y direction.

The COF substrate 98 of this embodiment has a rectangular shape of which the Xa-direction width is substantially constant, as illustrated in FIG. 16. In addition, the Xa-direction width of the opening portion 201 of the flow-path member 200 is substantially constant and slightly greater than that of the COF substrate 98. In other words, the opening portion 201 has a shape allowing the COF substrate 98 to be accommodated therein.

Figure 17:
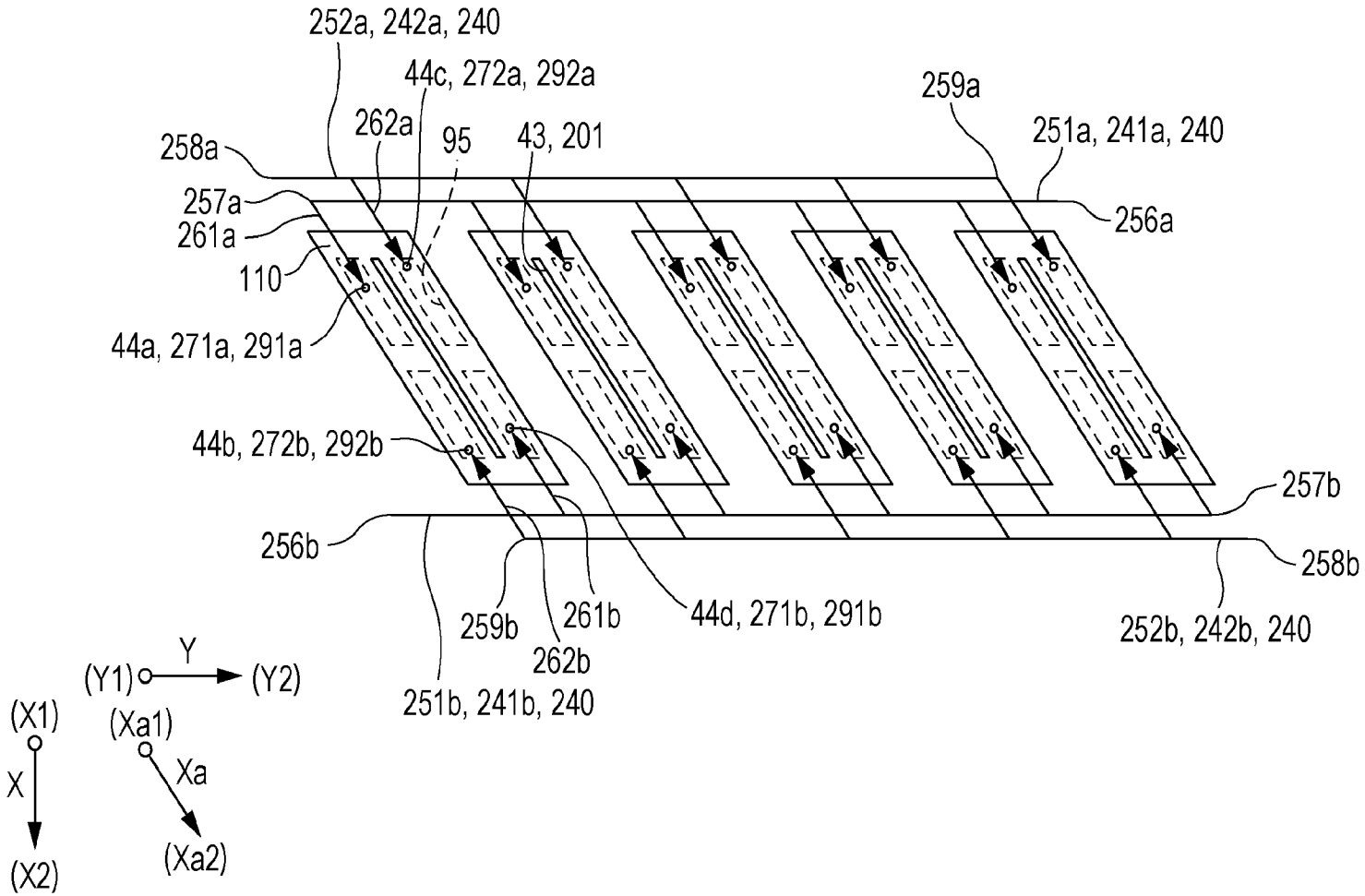
FIG. 17 is the schematic plan view of the flow path and the head main body.

FIG. 17 is a schematic plan view of the flow path and the head main body, when viewed from the Z2 side to the Z1 side in the Z direction. The arrangement of the flow path 240 and the head main body 110 will be described with reference to FIG. 17. In FIGS. 10 to 16, the first flow path portion 251*a* and the second flow path portion 252*a* partially overlap in the Z direction. However, in the illustration of FIG. 17, the first flow path portion 251*a* and the second flow path portion 252*a* do not overlap and deviate from each other. The first flow path portion 251*b* and the second flow path portion 252*b* have a similar configuration.

In the flow-path member 200, the opening portions 201 through which the COF substrates 98 are inserted are aligned in the Y direction. The first flow path portion 251 and the second flow path portion 252 are arranged in the X direction, with the opening portion 201 interposed therebetween. Specifically, a plurality (two, in this embodiment) of first flow path portions 251*a* and 251*b* are aligned in the X direction, with the head main body 110 interposed therebetween. In addition, a plurality (two, in this embodiment) of second flow path portions 252*a* and 252*b* are aligned in the X direction, with the head main body 110 interposed therebetween.

The first flow path portion 251 is disposed in a state where ink flows in one direction, in the first flow-path forming surface including both the first flow path portion 251 and the first bifurcation flow path portion 261. A flowing direction of ink in the first flow path portion 251 is a straight line connecting the start point and the end point of the first flow path portion 251. Accordingly, the middle portion of the first flow path portion 251 may not be bent or folded.

In this embodiment, the start point of the first flow path portion 251*a* is one end portion of the first flow path portion 251*a*. In other words, the start point of the first flow path portion 251*a* is a connection portion 256*a* between the first flow path portion 251*a* and the introduction flow path 281*a*. The end point of the first flow path portion 251*a* is an end portion 257*a* which is on a side opposite to the connection portion 256*a* of the first flow path portion 251*a*. A straight line connecting the connection portion 256*a* and the end portion 257*a* is parallel to the Y direction.

In this embodiment, the start point of the first flow path portion 251*b* is one end portion of the first flow path portion 251*b*. In other words, the start point of the first flow path portion 251*b* is a connection portion 256*b* between the first flow path portion 251*b* and the introduction flow path 281*b*. The end point of the first flow path portion 251*b* is an end portion 257*b* which is on a side opposite to the connection portion 256*b* of the first flow path portion 251*b*. A straight line connecting the connection portion 256*b* and the end portion 257*b* is parallel to the Y direction.

The second flow path portion 252 is disposed in a state where ink flows in one direction, in the second flow-path forming surface including both the second flow path portion 252 and the second bifurcation flow path portion 262. A flowing direction of ink in the second flow path portion 252 is a direction of a straight line connecting the start point and the end point of the second flow path portion 252. Accordingly, the middle portion of the second flow path portion 252 itself may not be bent or folded.

In this embodiment, the start point of the second flow path portion 252*a* is one end portion of the second flow path portion 252*a*. In other words, the start point of the second flow path portion 252*a* is a connection portion 258*a* between the second flow path portion 252*a* and the introduction flow path 282*a*. The end point of the second flow path portion 252*a* is an end portion 259*a* which is on a side opposite to the connection portion 258*a* of the second flow path portion 252*a*. A straight line connecting the connection portion 258*a* and the end portion 259*a* is parallel to the Y direction.

The start point of the second flow path portion 252*b* is one end portion of the second flow path portion 252*b*. In other words, the start point of the second flow path portion 252*b* is a connection portion 258*b* between the second flow path portion 252*b* and the introduction flow path 282*b*. The end point of the second flow path portion 252*b* is an end portion 259*b* which is on a side opposite to the connection portion 258*b* of the second flow path portion 252*b*. A straight line connecting the connection portion 258*b* and the end portion 259*b* is parallel to the Y direction.

At least a part of the first flow path portion 251 and a part of the second flow path portion 252 overlap in the Z direction which is a direction perpendicular to the liquid ejection surface 20*a*. Specifically, at least a part of the first flow path portion 251*a* and a part of the second flow path portion 252*a* overlap in the Z direction (see FIGS. 11, 12, 14, and 15). Similarly, at least a part of the first flow path portion 251*b* and a part of the second flow path portion 252*b* overlap in the Z direction.

The flowing direction of ink in the first flow path portion 251 described above and the flowing direction of ink in the second flow path portion 252 are opposite to each other. In other words, ink flows in the first flow path portion 251*a*, from the Y2 side to the Y1 side in the Y direction and, further, ink flows in the first flow path portion 252*a*, from the Y1 side to the Y2 side in the Y direction. Ink flows in the first flow path portion 251*b*, from the Y1 side to the Y2 side in the Y direction and, further, ink flows in the second flow path portion 252*b*, from the Y2 side to the Y1 side in the Y direction. In the flow path portions 250 which are formed in the same surface or the distribution flow path portions 250 of which at least parts overlap in the Z direction, the flowing directions of ink is opposite to each other, as described above.

Respective head main bodies 110 are disposed in the X direction, in a portion between a group of the first flow path portion 251*a* and the second flow path portion 252*a* and a group of the first flow path portion 251*b* and the second flow path portion 252*b*. The head main bodies 110 are aligned in the Y direction. Each head main body 110 is inclined in the Xa direction. The manifold 95 of each head main body 110 and the connection port 43 of the COF substrate 98 are also inclined in the Xa direction.

The first bifurcation flow path portion 261 and the second bifurcation flow path portion 262 which branch off in each head main body 110 communicate with the first flow path portion 251 and the second flow path portion 252. The first bifurcation flow path portion 261 and the second bifurcation flow path portion 262 communicate with a common head main body 110. In other words, the first bifurcation flow path portion 261 and the second bifurcation flow path portion 262 communicate with each head main body 110. In this embodiment, the first bifurcation flow path portion 261*a*, the second bifurcation flow path portion 262*a*, the first bifurcation flow path portion 261*b*, and the second bifurcation flow path portion 262*b* communicate with each head main body 110. Specifically, the first bifurcation flow path portion 261 and the second bifurcation flow path portion 262 communicate with the introduction path 44 of the head main body 110 via both the first vertical flow path 271 and the second vertical flow path 272.

In the Z2-side surface of the head main body 110, four introduction paths 44 are formed around the connection port 43. Specifically, two introduction paths 44*a* and 44*b* are open in areas further on the Ya1 side in the Ya direction than the connection port 43. The introduction path 44*a* is disposed further on the Xa1 side in the Xa direction than the introduction path 44*b*. Two remaining introduction paths 44*c* and 44*d* are open in areas further on the Ya2 side in the Ya direction than the connection port 43. The introduction path 44*c* is disposed further on the Xa1 side in the Xa direction than the introduction path 44*d*. The connection port 43 and the opening portion 201 have substantially the same shape. The connection port 43 and the opening portion 201 communicate with each other.

The introduction path 44*a* is connected to the first flow path 241*a*, in other words, the first introduction flow path 281*a* (see FIG. 14), the first flow path portion 251*a*, the first bifurcation flow path portion 261*a*, the first vertical flow path 271*a*, and the first connection portion 291*a*.

The introduction path 44*b* is connected to the second flow path 242*b*, in other words, the second introduction flow path

282*b* (see FIG. 15), the second flow path portion 252*b*, the second bifurcation flow path portion 262*b*, the second vertical flow path 272*b*, and the second connection portion 292*b*.

The introduction path 44*c* is connected to the second flow path 242*a*, in other words, the second introduction flow path 282*a* (see FIG. 14), the second flow path portion 252*a*, the second bifurcation flow path portion 262*a*, the second vertical flow path 272*a*, and the second connection portion 292*a*.

The introduction path 44*d* is connected to the first flow path 241*b*, in other words, the first introduction flow path 281*b* (see FIG. 15), the first flow path portion 251*b*, the first bifurcation flow path portion 261*b*, the first vertical flow path 271*b*, and the first connection portion 291*b*.

The relationship between the introduction paths 44*a* to 44*d*, the first flow path 241, and the second flow path 242 are the same in the remaining five head main bodies 110.

The COF substrate 98 is inserted through the connection port 43. In the Ya direction, the COF substrate 98 is disposed in a portion between the first bifurcation flow path portion 261*a* and the second bifurcation flow path portion 262*a*, in other words, in a portion between the first bifurcation flow path portion 261*b* and the second bifurcation flow path portion 262*b*.

Figure 18:
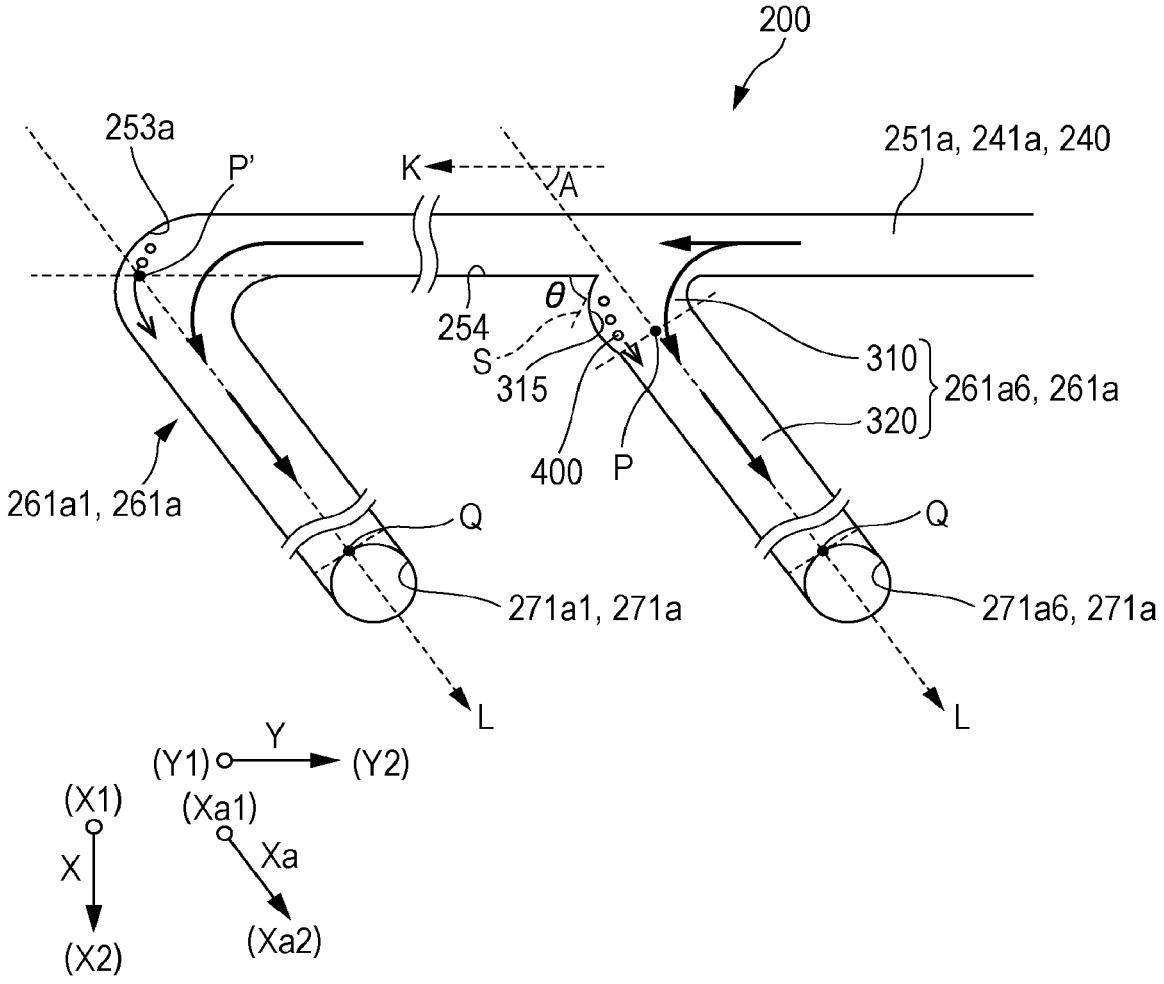
FIG. 18 is an enlarged schematic plan view illustrating principal portions of a first flow path portion and a first bifurcation flow path portion.

FIG. 18 is an enlarged schematic plan view illustrating principal portions of the first flow path portion 251*a* and the first bifurcation flow path portion 261*a*. In other words, FIG. 18 is a plan view of the first flow-path forming surface when viewed from the Z2 side to the Z1 side in the Z direction. The specific configurations of both the first flow path portion 251*a* and the first bifurcation flow path portion 261*a* will be described with reference to FIG. 18. The first flow path portion 251*b* and the first bifurcation flow path portion 261*b* have shapes which are obtained by inverting, in the X direction and the Y direction, the shapes of both the first flow path portion 251*a* and the first bifurcation flow path portion 261*a*. Thus, the first flow path portion 251*b* and the first bifurcation flow path portion 261*b* are not illustrated in the accompanying drawing. However, the first flow path portion 251*b* and the first bifurcation flow path portion 261*b* have the same operational effect as that of the first bifurcation flow path portion 261*a*.

The first bifurcation flow path portion 261*a* includes an upstream-side flow path portion 310 and a downstream-side flow path portion 320. The upstream-side flow path portion 310 communicates with the first flow path portion 251*a*. The downstream-side flow path portion 320 communicates with the first flow path portion 251*a* through the upstream-side flow path portion 310.

The upstream-side flow path portion 310 is a flow path which constitutes the first bifurcation flow path portion 261*a* and directly communicates with the first flow path portion 251*a*. In a plan view of the first flow-path forming surface, a second wall surface 315 of the upstream-side flow path portion 310 has an R shape. Details of this will be described below.

The downstream-side flow path portion 320 is a flow path which constitutes the first bifurcation flow path portion 261*a* and communicates with the first flow path portion 251*a* through the upstream-side flow path portion 310. In addition, the downstream-side flow path portion 320 also communicates with the first vertical flow path 271*a*. The downstream-side flow path portion 320 communicates with the head main body 110 through the first vertical flow path 271*a*. The downstream-side flow path portion 320 extends in a straight-line of which the width is substantially constant.

Furthermore, the cross-sectional area of the first vertical flow path 271*a* is smaller than that of the downstream-side flow path portion 320. When the cross-sectional area of the first vertical flow path 271*a* changes in accordance with the position of a cross-sectional surface thereof, for example, the mean value of the cross-sectional area of the first vertical flow path 271*a* at each position may be set to a cross-sectional area. When the cross-sectional area of the downstream-side flow path portion 320 changes in accordance with the position of a cross-sectional surface thereof, for example, the mean value of the cross-sectional area of the downstream-side flow path portion 320 at each position may be set to a cross-sectional area In this embodiment, the six first bifurcation flow path portions 261*a*1 to 261*a*6 are provided. Although not illustrated, the first bifurcation flow path portions 261*a*2 to 261*a*5 and the first bifurcation flow path portion 261*a*6 have the same configuration. The first bifurcation flow path portion 261*a*6 has the upstream-side flow path portion 310 and the downstream-side flow path portion 320. The first bifurcation flow path portion 261*a*1 which is located at the farthest downstream side of the first flow path portion 251*a* is bent at a downstream-side end portion of the first flow path portion 251*a* and extends to the Xa2 side in the Xa direction. In other words, not necessarily all of the plurality of first bifurcation flow path portions 261*a* have both the upstream-side flow path portions and the downstream-side flow path portions.

In this case, the first flow path portion 251*a* is disposed in the flow-path member 200, in a state where an angle between the flowing direction of ink in the first flow path portion 251*a* and the flowing direction of ink in the downstream-side flow path portion 320 is an acute angle.

The flowing direction of ink in the downstream-side flow path portion 320 is the direction of a straight line connecting both ends of the downstream-side flow path portion 320. In the first bifurcation flow path portions 261*a*2 to 261*a*5 of this embodiment, the direction along a straight line which passes through a point P in a boundary surface between the upstream-side flow path portion 310 and the downstream-side flow path portion 320 and a point Q in a boundary surface between the downstream-side flow path portion 320 and the first vertical flow path 271*a* is set to a direction L in which ink flows in the downstream-side flow path portion 320. In the first bifurcation flow path portion 261*a*1, the direction along a straight line which passes through a point P' in a boundary surface between the first bifurcation flow path portion 261*a*1 and the first flow path portion 251 and a point Q in a boundary surface between the first bifurcation flow path portion 261*a*1 and the first vertical flow path 271*a* is set to a direction L. In this embodiment, the direction L is parallel to the Xa direction. Meanwhile, in this embodiment, a direction in which ink flows in the first flow path portion 251*a* is set to a direction K directed from the Y2 side to the Y1 side in the Y direction, as described above.

An angle A between the direction L in which ink flows in the downstream-side flow path portion 320 and the direction K in which ink flows in the first flow path portion 251*a* is an acute angle. In other words, the Y-direction component of the direction L is directed opposite to that of the direction K.

When the angle between the direction L in which ink flows in the downstream-side flow path portion 320 and the direction K in which ink flow in the first flow path portion 251*a* is an acute angle, as described above, ink flows in the first flow path portion 251*a*, from the Y2 side to the Y1 side in the Y direction. Then, in the upstream-side flow path portion 310, the flowing direction of ink changes to a direction directed from the Y1 side to the Y2 side in the Y direction. Next, ink flows in the direction L, in the downstream-side flow path portion 320. The angle A between the direction L and the direction K may be 0°. In other words, an angle between a direction in which ink flows in the downstream-side flow path portion 320 and a direction in which ink flows in the first flow path portion 251*a* may be 180°. In all of the first bifurcation flow path portions 261*a* of this embodiment, angles A between the directions K in which ink flows in the first flow path portions 251*a* and the directions L in which ink flows in the downstream-side flow path portions 320 are the same. However, the angles A may be different from each other.

Here, in the plan view of the first flow-path forming surface, a wall surface of the first flow path portion 251*a*, which is the wall surface downstream from the upstream-side flow path portion 310 is set to a first wall surface 254. In this embodiment, respective first wall surfaces 254 are side surfaces of the first flow path portion 251*a*, which are the side surfaces on the X2 side in the X direction and are located downstream from the first bifurcation flow path portions 261*a*1 to 261*a*5.

Furthermore, in the plan view of the first flow-path forming surface, wall surfaces of the respective upstream-side flow path portions 310 connected to the first wall surfaces 254 are set to a second wall surfaces 315. In other words, in the plan view of the first flow-path forming surface, one of the side surfaces of the upstream-side flow path portion 310, which is located on a downstream side in a direction in which ink flows in the first flow path portion 251*a*, is set to the second wall surface 315.

A wall surface 253*a* of the downstream-side end portion of the first flow path portion 251*a* is formed in a curved shape. The side surface (which is the downstream-side side surface of the first flow path portion 251*a*) of the first bifurcation flow path portion 261*a*1 is connected to the wall surface 253*a*.

In the plan view of the first flow-path forming surface, an angle θ between the first wall surface 254 and the second wall surface 315 is equal to or less than 90°. The second wall surface 315 is formed in an R shape, as described below. Accordingly, an angle between a tangent line S of the second wall surface 315 passing through a contact point between the first wall surface 254 and the second wall surface 315 and the first wall surface 254 is set to the angle θ. The angle θ is an angle on a side including walls which constitute the first flow path portion 251*a* and the upstream-side flow path portion 310. In other words, the angle θ is not an angle on a side including space portions of both the first flow path portion 251*a* and the upstream-side flow path portion 310.

In the plan view of the first flow-path forming surface, the second wall surface 315 which intersects with the first wall surface 254 of the first flow path portion 251*a*, at the angle θ, has an R shape, as described above. In the plan view of the first flow-path forming surface, the second wall surface 315 is formed in an R shape (in other words, an arc shape) protruding toward the downstream side of the first flow path portion 251*a*. In other words, a part of the first bifurcation flow path portion 261*a*, which is the portion connected to the first wall surface 254 and includes the second wall surface 315 having an R shape, is the upstream-side flow path portion 310. A part of the first bifurcation flow path portion 261*a*, which is the portion connected to the second wall surface 315 and has a straight-line-shaped side surface, is the downstream-side flow path portion 320.

In this embodiment, a side surface of the upstream-side flow path portion 310, which is located on a side opposite to the second wall surface 315, also has an R shape. However, the configuration is not limited thereto. The side surface of the upstream-side flow path portion 310 may have a flat-surface shape.

In such a flow-path member 200, ink flows in the first flow path portion 251*a*, from the Y2 side to the Y1 side in the Y direction. The ink flow branches into several paths which flow in the first bifurcation flow path portions 261*a*2 to 261*a*6. The remainder of the ink flows in the first bifurcation flow path portion 261*a*1 on the end side of the first flow path portion. In the upstream-side flow path portions 310, the direction of ink flowing in the respective first bifurcation flow path portions 261*a*2 to 261*a*6 changes to a direction moving from the Y1 side to the Y2 side in the Y direction. Then, ink flows in the direction L, in the downstream-side flow path portions 320.

Here, when it is assumed that air bubbles 400 are contained in ink, the movement of the air bubbles 400 is as follows.

In the first bifurcation flow path portions 261*a*2 to 261*a*6, the second wall surfaces 315 of the respective upstream-side flow path portions 310 have an R shape. Accordingly, it is easy to allow air bubbles to move along the second wall surface 315. Furthermore, since the angle θ between the first wall surface 254 and the second wall surface 315 is equal to or less than 90°, the air bubbles 400 which move along the second wall surface 315 can be directed from the upstream-side flow path portion 310 to the downstream-side flow path portion 320.

When the second wall surface 315 has a flat-surface shape, there is a concern that air bubbles may adhere to the second wall surface 315, and thus the air bubbles remain in the upstream-side flow path portion 310. When air bubbles remain in the upstream-side flow path portion 310, the size of air bubbles gradually increases and the bubbles flow, at an unexpected time, into the head main body 110 through the first vertical flow path 271*a*. As a result, there is a concern that ejection failure of ink may occur. In a case where it is assumed that the angle θ is greater than 90°, even when air bubbles move along the second wall surface 315, the air bubbles move to the first flow path portion 251*a* side. As a result, there is a concern that the air bubbles may remain in the first flow path portion 251*a* or the air bubbles 400 may collect in the first bifurcation flow path portion 261*a*1 on the end side of the first flow path portion.

In the plurality of first bifurcation flow path portions 261*a*2 to 261*a*6 of the flow-path member 200 of this embodiment, the respective angles θ are set to be equal to or less than 90° and the respective second wall surfaces 315 are formed in an R shape. Accordingly, when the air bubbles 400 flow into the first bifurcation flow path portions 261*a*2 to 261*a*6, it is possible to allow the air bubbles 400 to flow to the downstream side while preventing the air bubbles 400 from returning to the first flow path portion 251*a*. As a result, the air bubbles 400 can be substantially evenly divided over the first bifurcation flow path portions 261*a*1 to 261*a*6, and then are discharged to the outside (in other words, the head main body 110) of the flow-path member 200. In other words, the air bubbles 400 can be prevented from collecting in one of the first bifurcation flow path portions 261*a*1 to 261*a*6. Accordingly, it is possible to reduce a possibility that the air bubbles 400 may collect in the first bifurcation flow path portion 261*a*1 on the end side of the first flow path portion, and thus ejection failure of ink occurs in the head main body 110 communicating with the first bifurcation flow path portion 261*a*1.

Flow paths which correspond to the first flow path portion 251*a* and the first bifurcation flow path portion 261*a* of the flow-path member 200 and each of which branch into a plurality of flow paths are not provided in the head main body 110 having a plurality of manifolds 95. In other words, since the first bifurcation flow path portion 261*a* is provided in the flow-path member 200 which is a member separate from the head main body 110, the degree of freedom in the arrangement of the head main body 110 is improved.

When the angle between the first flow path portion 251*a* and the first bifurcation flow path portion 261*a* and the arrangement thereof are set including giving priority to air-bubble discharge properties, it is necessary to arrange the head main body 110 connected to the first bifurcation flow path portion 261*a*, in accordance with the setting.

However, in the flow-path member 200 of this embodiment, the angle θ is set to be equal to or less than 90° and the second wall surface 315 has an R shape, in such a manner that air-bubble discharge properties are improved. Accordingly, the flow-path member 200 can have a configuration in which the head main bodies 110 are freely arranged to meet the use or the purpose of the recording head 100 and the angle between the first flow path portion 251*a* and the downstream-side flow path portion 320 is set, in accordance with the arrangement of the head main bodies, to be an acute angle. In other words, it is possible to achieve both the degree of freedom in the arrangement of the head main bodies 110 and the improvement in air-bubble discharge properties.

Figure 19:
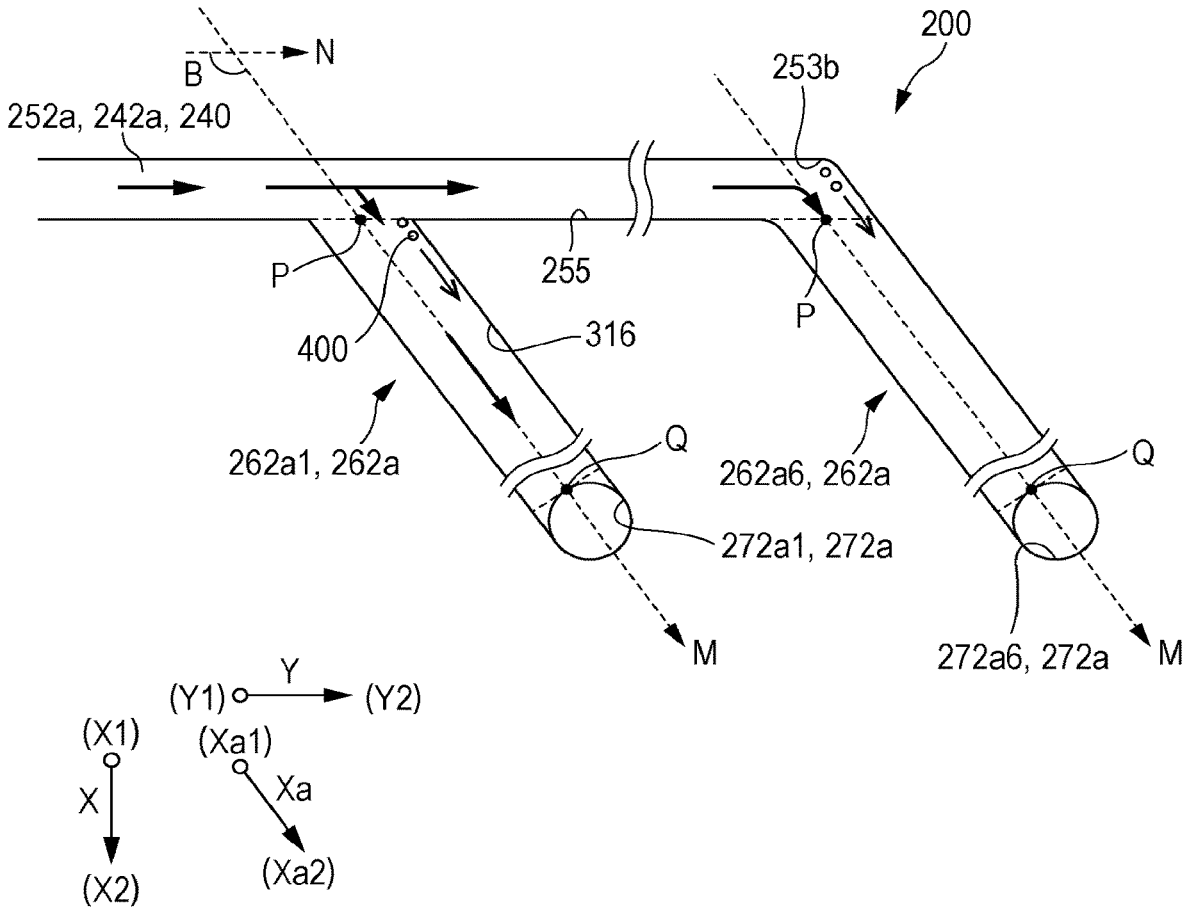
FIG. 19 is an enlarged schematic plan view illustrating principal portions of a second flow path portion and a second bifurcation flow path portion.

FIG. 19 is an enlarged schematic plan view illustrating principal portions of the second flow path portion and the second bifurcation flow path portion. In other words, FIG. 19 is a plan view of the second flow-path forming surface when viewed from the Z2 side to the Z1 side in the Z direction. The specific configurations of both the second flow path portion 252*a* and the second bifurcation flow path portion 262*a* will be described with reference to FIG. 19. The second flow path portion 252*b* and the second bifurcation flow path portion 262*b* have shapes which are obtained by inverting, in the X direction and the Y direction, the shapes of both the second flow path portion 252*a* and the second bifurcation flow path portion 262*a*. Thus, the second flow path portion 252*b* and the second bifurcation flow path portion 262*b* are not illustrated in the accompanying drawing. However, a group of the second flow path portion 252*b* and the second bifurcation flow path portion 262*b* and a group of second flow path portion 252*a* and the second bifurcation flow path portion 262*a* have the same operational effect.

One end of the second bifurcation flow path portion 262*a* communicates with the second flow path portion 252*a* and the other end communicates with the second vertical flow path 272*a*. The second bifurcation flow path portion 262*a* communicates with the head main body 110 through the second vertical flow path 272*a*. The second bifurcation flow path portion 262*a* extends in a straight-line of which the width is substantially constant. In this embodiment, the six second bifurcation flow path portions 262*a*1 to 262*a*6 are provided. Although not illustrated, the second bifurcation flow path portions 262*a*2 to 262*a*5 and the second bifurcation flow path portion 262*a*6 have the same configuration. Respective second bifurcation flow path portions 262*a*6 extend to the Xa2 side in the Xa direction. The configuration of the second bifurcation flow path portion 262*a* is not limited thereto. The width of the second bifurcation flow path portion 262*a* may be gradually increased or reduced as it extends to the second vertical flow path 272*a* side.

In this case, the second flow path portion 252*a* is provided in the flow-path member 200, in a state where an angle between the flowing direction of ink in the second flow path portion 252*a* and the flowing direction of ink in the second bifurcation flow path portion 262*a* is an obtuse angle.

The flowing direction of ink in the second bifurcation flow path portion 262*a* is the direction of a straight line connecting both ends of the second bifurcation flow path portion 262*a*. In this embodiment, the direction along a straight line which passes through a point P in a boundary surface between the second bifurcation flow path portion 262*a* and the second flow path portion 252*a* and a point Q in a boundary surface between the second bifurcation flow path portion 262*a* and the second vertical flow path 272*a* is set to a direction M in which ink flows in the second bifurcation flow path portion 262*a*. In this embodiment, the direction M is parallel to the Xa direction. Meanwhile, in this embodiment, a direction in which ink flows in the second flow path portion 252*a* is set to a direction N moving from the Y1 side to the Y2 side in the Y direction, as described above.

An angle B between the direction M in which ink flows in the second bifurcation flow path portion 262*a* and the direction N in which ink flows in the second flow path portion 252*a* is an obtuse angle. In other words, the Y-direction component of the direction M is directed opposite to that of the direction N.

When the angle between the direction M in which ink flows in the second bifurcation flow path portion 262*a* and the direction N in which ink flows in the second flow path portion 252*a* is an obtuse angle, as described above, ink flows in the second flow path portion 252*a*, from the Y1 side to the Y2 side in the Y direction. Then, ink flows in the direction M, in the second bifurcation flow path portion 262*a*. In all of the second bifurcation flow path portions 262*a* of this embodiment, angles B between the directions N in which ink flows in the second flow path portion 252*a* and the directions M in which ink flows in the second bifurcation flow path portion 262*a* are the same. However, the angles B may be different from each other.

Here, in a plan view of the second flow-path forming surface, a wall surface of the second flow path portion 252*a*, which is the wall surface downstream from the second bifurcation flow path portion 262*a* is set to a third wall surface 255. In this embodiment, respective third wall surfaces 255 are side surfaces of the second flow path portion 252*a*, which are the side surfaces on the X2 side in the X direction and are located downstream from the second bifurcation flow path portions 262*a*1 to 262*a*5.

Furthermore, in the plan view of the second flow-path forming surface, wall surfaces of the respective second bifurcation flow path portion 262*a* connected to the third wall surfaces 255 are set to a fourth wall surfaces 316. In other words, in the plan view of the second flow-path forming surface, one of the side surfaces of the second bifurcation flow path portion 262*a*, which is located on a downstream side in a direction in which ink flows in the second flow path portion 252*a*, is set to the fourth wall surface 316.

A wall surface 253*b* of the downstream-side end portion of the second flow path portion 252*a* is formed in a curved shape. The side surface (which is the downstream-side side surface of the second flow path portion 252*a*) of the second bifurcation flow path portion 262*a*1 is connected to the wall surface 253*b*.

In such a flow-path member 200, ink flows in the second flow path portion 252*a*, from the Y1 side to the Y2 side in the Y direction. The ink flow branches into several paths which flow in the second bifurcation flow path portions 262*a*1 to 262*a*5. The remainder of the ink flows in the second bifurcation flow path portion 262*a*6 on the end side of the second flow path portion. Then, ink flows in the direction M, in the respective second bifurcation flow path portions 262*a*.

Here, when it is assumed that the air bubbles 400 are contained in ink, the movement of the air bubbles 400 is as follows.

In the second bifurcation flow path portions 262*a*1 to 262*a*5, the angle between the direction M described above and the direction N is an obtuse angle. In other words, the fourth wall surface 316 of the second bifurcation flow path portion 262*a* intersects, at an obtuse angle, with the direction N in which ink flows in the second flow path portion 252*a*. Accordingly, it is easy to allow air bubbles to move along the fourth wall surface 316, toward the second vertical flow path 272*a* side on the downstream side. The air bubbles 400 in ink, which flow from the second flow path portion 252*a* to the second bifurcation flow path portion 262*a*, flow in the second bifurcation flow path portion 262*a*. As a result, it is difficult for the air bubbles 400 to flow back to the second flow path portion 252*a* side.

In a plurality of second bifurcation flow path portions 262*a*1 to 262*a*5 of the flow-path member 200 of the embodiment, the angle between the direction M in which ink flows and the direction N in which ink flows in the second flow path portion 252*a* is set to an obtuse angle. Accordingly, when the air bubbles 400 flow into the second bifurcation flow path portions 262*a*1 to 262*a*5, it is possible to allow the air bubbles 400 to flow to the downstream side while preventing the air bubbles 400 from returning to the second flow path portion 252*a*. As a result, the air bubbles 400 can be substantially evenly divided over the second bifurcation flow path portions 262*a*1 to 262*a*6, and then are discharged to the outside (in other words, the head main body 110) of the flow-path member 200. In other words, the air bubbles 400 can be prevented from collecting in one of the second bifurcation flow path portions 262*a*1 to 262*a*6. Accordingly, it is possible to reduce a possibility that the air bubbles 400 may collect in the second bifurcation flow path portion 262*a*6 on the end side of the second flow path portion, and thus ejection failure of ink occurs in the head main body 110 communicating with the second bifurcation flow path portion 262*a*6.

Flow paths which correspond to the second flow path portion 252*a* and the second bifurcation flow path portion 262*a* of the flow-path member 200 and each of which branch into a plurality of flow paths are not provided in the head main body 110 having the plurality of manifolds 95. In other words, since the second bifurcation flow path portion 262*a* is provided in the flow-path member 200 which is a member separate from the head main body 110, the degree of freedom in the arrangement of the head main body 110 is improved.

When the angle between the second flow path portion 252*a* and the second bifurcation flow path portion 262*a* and the arrangement thereof are set including giving priority to air-bubble discharge properties, it is necessary to arrange the head main body 110 connected to the second bifurcation flow path portion 262*a*, in accordance with the setting.

However, in the flow-path member 200 of this embodiment, the angle between the direction M in which ink flows in the second bifurcation flow path portion 262*a* and the direction N in which ink flows in the second flow path portion 252*a* is set to be an obtuse angle, in such a manner that air-bubble discharge properties are improved. Accordingly, the flow-path member 200 can have a configuration in which the head main bodies 110 are freely arranged to meet the use or the purpose of the recording head 100 and the angle between the direction M in which ink flows in the second flow path portion 252*a* and the direction N in which ink flows in the second bifurcation flow path portion 262*a* is set, in accordance with the arrangement of the head main bodies, to be an obtuse angle. In other words, it is possible to achieve both the degree of freedom in the arrangement of the head main bodies 110 and the improvement in air-bubble discharge properties.

In the flow-path member 200 of this embodiment, the cross-sectional area of the first vertical flow path 271*a* is smaller than that of the downstream-side flow path portion 320. Accordingly, the flow velocity of ink in the first vertical flow path 271*a* is faster than the flow velocity of ink in the downstream-side flow path portion 320. As a result, it is easy for air bubbles in ink to flow through the first vertical flow path 271*a* and, further, it is possible to further prevent air bubbles from remaining in the downstream-side flow path portion 320.

The cross-sectional area of the first vertical flow path 271*a* may be equal to or greater than that of the downstream-side flow path portion 320.

In the flow-path member 200 of this embodiment, a plurality (two, in this embodiment) of first flow path portions 251*a* and 251*b* are formed in the first flow-path forming surface, as described above. Since the flow-path member 200 has the plurality of first flow path portions 251, a plurality of inks can be supplied to the head main body 110 through different paths. Furthermore, it is possible to reduce the Z-direction size of the flow-path member 200 of this embodiment, compared to the configuration in which the first flow path portion 251*a* and the first flow path portion 251*b* are disposed in different surfaces in the Z direction.

Similarly, in the flow-path member 200 of this embodiment, a plurality (two, in this embodiment) of second flow path portions 252*a* and 252*b* are formed in the second flow-path forming surface. Since the flow-path member 200 has the plurality of second flow path portions 252, a plurality of inks can be supplied to the head main body 110 through different paths. Furthermore, it is possible to reduce the Z-direction size of the flow-path member 200 of this embodiment, compared to the configuration in which the second flow path portion 252*a* and the second flow path portion 252*b* are disposed in different surfaces in the Z direction. The colors of the plurality of inks may be the same.

The number of first flow path portions 251 and the number of second distribution flow paths 252 may be one or may be three or more. Furthermore, a plurality of first flow path portions 251 and the second distribution flow paths 252 may be provided in different surfaces.

The flow-path member 200 of this embodiment is constituted of three members, that is, the first flow-path member 210, the second flow-path member 220, and the third flow-path member 230, as described above. The first flow path portion 251 is provided in the first flow-path forming surface which is the boundary surface between the first flow-path member 210 and the second flow-path member 220. In addition, the second flow path portion 252 is provided in the second flow-path forming surface which is the boundary surface between the second flow-path member 220 and the third flow-path member 230.

According to such a flow-path member 200, the first flow path portion 251 and the second flow path portion 252 can be formed by at least three members. As a result, the number of parts can be reduced.

When only the first flow path 241 and the first flow path portion 251 are provided without both the second flow path 242 and the second flow path portion 252, the flow-path member may be constituted of the first flow-path member 210 and the second flow-path member 220. In this case, the first flow path portion 251 can be formed by at least two members. As a result, it is possible to reduce the number of parts.

In the flow-path member 200 of this embodiment, the COF substrate 98 is disposed in the portion between the first bifurcation flow path 261*a* and the second bifurcation flow path portion 262*a*, in other words, in the portion between the first bifurcation flow path portion 261*b* and the second bifurcation flow path portion 262*b*. In other words, in the flow-path member 200, both the first bifurcation flow path portion 261 and the second bifurcation flow path portion 262 are arranged avoiding the COF substrate 98. In the head main body 110, the manifolds 95 and the introduction paths 44 communicating with the manifolds 95 are provided on both sides, with the COF substrate 98 interposed therebetween. Accordingly, when it is assumed that both the first bifurcation flow path portion 261 and the second bifurcation flow path portion 262 are disposed in an area on one surface side of the COF substrate 98, it is necessary to form, in the flow-path member 200, a flow path of either the first bifurcation flow path portion 261 or the second bifurcation flow path portion 262, in a state where the flow path extends around the COF substrate 98 and communicates with the manifold 95. As a result, the size of the flow-path member 200 increases. However, in the flow-path member 200 of this embodiment, the first bifurcation flow path portion 261 and the second bifurcation flow path portion 262 are arranged with the COF substrate 98 interposed therebetween, to correspond to the head main body 110 in which the manifolds 95 and the introduction paths 44 communicating with the manifolds 95 are arranged on both sides with the COF substrate 98 interposed therebetween. Thus, the size of the head main body 110 and the flow-path member 200 can be reduced. Furthermore, it is not necessary to form both the first bifurcation flow path portion 261 and the second bifurcation flow path portion 262 to bypass the COF substrate 98. Thus, it is possible to remove a space which is necessary in a case where the bifurcation flow path portions extends bypassing the COF substrate. As a result, in a plan view, density in the arrangement of the COF substrates 98 can be increased. In other words, it is possible to reduce a gap between the head main bodies 110, and thus the size of the recording head 100 also can be reduced.

In the flow-path member 200 of this embodiment, both the first bifurcation flow path portion 261 and the first flow path portion 251 are formed in the first flow-path forming surface and both the second bifurcation flow path portion 262 and the second flow path portion 252 are formed in the second flow-path forming surface, as described above. The flow of ink in the first flow path portion 251 branches into several flows which flow in the respective first bifurcation flow path portions 261 and the flow of ink in the second flow path portion 252 branches into several flows which flow in the respective second bifurcation flow path portions 262. Inks of the branched-off flows are supplied to one head main body 110. In other words, the first flow path 241*a*, the first flow path 241*b*, the second flow path 242*a*, and the second flow path 242*b* are connected to one head main body 110.

According to such a flow-path member 200, it is possible to supply a plurality of inks to one head main body 110 and, further, air bubbles from the flow-path member 200 can be prevented from being intensively sent to a specific head main body 110 of the plurality of the head main bodies 110. In addition, the first flow path portion 251 and the second flow path portion 252 of which the angles in the middle of the flow paths are different from each other are used, and thus, even when a plurality of liquids are supplied to a plurality of head main bodies 110, it is possible to improve the degree of freedom in the arrangement of the head main body 110.

The flow-path member 200 has a two-layer-structure which includes both the first flow-path forming surface and the second flow-path forming surface of which positions are different in the Z direction. However, the configuration is not limited thereto. A group of the first flow path portion 251 and the first bifurcation flow path portion 261 and a group of the second flow path portion 252 and the second bifurcation flow path portion 262 may be formed in the same surface in the Z direction. A group of the first flow path portion 251 and the first bifurcation flow path portion 261 and a group of the second flow path portion 252 and the second bifurcation flow path portion 262 may be formed in the first flow-path forming surface which is the boundary surface between the first flow-path member 210 and the second flow-path member 220. In this case, since the flow paths can be formed by at least two members, it is possible to reduce the number of parts. Thus, it is possible to reduce the cost. Furthermore, the thickness of the flow-path member 200 in the Z direction can be reduced, and thus the size of the flow-path member 200 can be reduced.

The flowing direction of ink in the first flow path portion 251 is opposite to the flowing direction of ink in the second flow path portion 252. However, the configuration is not limited thereto.

The flow-path member 200 of this embodiment includes, in total, four flow paths 240 and inks of different kinds which flow through the flow paths 240. As a result, a plurality of different inks can be supplied to one head main body 110. Needless to say, the configuration is not limited thereto. Inks of the same kind may flow through different flow paths 240.

In this case, it is preferable that, among a plurality of inks, an ink having the most inferior air-bubble discharge properties flow through the first flow path portion 251.

The air-bubble discharge properties mean the degree of ease in discharging the air-bubbles to the outside from the first flow path portion 251 and the second flow path portion 252 (in other words, the head main body 110 side) when ink containing air bubbles flows into the first flow path portion 251 and the second flow path portion 252 of the flow-path member 200.

In the second flow path portion 252 of this embodiment, the angle between the direction N in which ink flows and the direction M in which ink flows in the second bifurcation flow path portion 262 is an obtuse angle, as described above. In other words, since the Y-direction component of the direction M and the Y-direction component of the direction N are directed to the same direction, it is easy for ink to flow from the second flow path portion 252 to the respective second bifurcation flow path portions 262, as illustrated in FIG. 19. Thus, the second flow path portion 252 has a structure in which it is difficult for ink to flow backward. In other words, the second flow path portion 252 has a configuration in which it is easy for air bubbles in ink to be discharged to the outside while preventing the air bubbles from remaining in the second flow path portion 252 or the second bifurcation flow path portion 262. In other words, upon comparison with in the case of both the second flow path portion 252 and the second bifurcation flow path portion 262, it is difficult for both the first flow path portion 251 and the first bifurcation flow path portion 261 to discharge air bubbles to the outside.

Accordingly, it is preferable that the ink having the most inferior air-bubble discharge properties flow not through both the first flow path portion 251 and the first bifurcation flow path portion 261 but through both the second flow path portion 252 and the second bifurcation flow path portion 262. In this case, the ink having the inferior air-bubble discharge properties flows through the second flow path portion 252 in which it is relatively easy for air bubbles to be discharged, compared to in the case of the first flow path portion 251. Thus, it is possible to further reduce the possibility that air bubbles may remain in the flow-path member 200.

The plurality of inks may flow through either the first flow path portion 251 or the second flow path portion 252, regardless of the air-bubble discharge properties thereof.

Examples of the air-bubble discharge properties described above include foaming properties and defoaming properties. The foaming properties mean the ease in generating air bubbles in ink. The defoaming properties mean the ease in eliminating air bubbles generated in ink. When foaming properties of ink are inferior, air-bubble discharge properties, for example, are superior. When defoaming properties of ink are superior, air-bubble discharge properties are superior. In accordance with both properties described above, it is possible to prevent ink having inferior air-bubble discharge properties from flowing through both the first flow path portion 251 and the first bifurcation flow path portion 261.

Furthermore, it is preferable that air-bubble discharge properties be specified in order of foaming properties and the defoaming properties. In this case, ink in which air bubbles are likely to be generated can preferentially flow through flow path portions other than the first flow path portion 251 and the first bifurcation flow path portion 261.

Furthermore, in the flow-path member 200 of this embodiment, at least a part of the first flow path portion 251 and a part of the second flow path portion 252 overlap in the Z direction perpendicular to the liquid ejection surface 20*a*. Accordingly, the size of the flow-path member 200 can be reduced in a plane direction of the liquid ejection surface 20*a*, compared to in the case where all of the plurality of flow path portions are formed in the same plane.

The recording head 100 includes the flow-path member 200 in which the degree of freedom in the arrangement of the flow path 240 and the head main body 110 are ensured and air bubbles are prevented from remaining in the bifurcation flow path portion 260. Accordingly, the head main bodies 110 are arranged without depending on the configuration of the flow path, and thus it is possible to achieve, for example, a reduction in the size of the recording head 100. In addition, ink ejection properties are improved. Furthermore, in the ink jet type recording apparatus 1 having the recording head 100, the ink ejection properties are improved by the recording head 100 having a small size.

OTHER EMBODIMENTS

Hereinbefore, the embodiments of the invention are described. However, the basic configuration of the invention is not limited thereto.

When the nozzle rows a and b of each head main body 110 of the recording head 100 extend in the Xa direction and the nozzle rows a and b are inclined with respect to the X direction as the transporting direction, the X direction and the Xa direction may intersect at an angle greater than 0° and less than 90°. However, the invention also includes the recording head 100 having a configuration in which the X direction and the Xa direction do not intersect. In other words, in a recording head, the head main body 110 may have a configuration in which the Xa direction as a direction of the nozzle row is perpendicular to the X direction as the transporting direction. In this case, the Xa direction is parallel to the Y direction and the Ya direction is parallel to the X direction. Accordingly, in the recording head 100 of Embodiment 1, the size in the Ya direction is reduced. However, in the recording head 100 having the configuration in which the Ya direction is parallel to the X direction, the size thereof can be reduced in the X direction, in other words, the transporting direction of the recording sheet S, which is parallel to the Ya direction. The flow-path member 200 of the invention can be applied to the recording head 100 having such a configuration.

The recording head 100 includes a plurality of head main bodies 110. However, the configuration is not limited thereto. The recording head 100 may have a configuration in which one head main body has a plurality of nozzle rows and a plurality of manifolds communicating with respective nozzle rows and a flow-path member which supplies ink to respective manifolds of the head main body is provided.

The flow-path member 200 has, as the first flow path 241, two flow paths which are the first flow path 241*a* and the first flow path 241*b*. However, the number of first flow paths is not limited thereto. One first flow path may be provided or three or more first flow paths may be provided. The second flow path 242 has a similar configuration described above.

The first flow path portion 251*a* branches into the six first bifurcation flow path portions 261*a*. However, the configuration is not limited thereto. The first flow path portion 251*a* may be connected to one head main body 110, without being branched. The number of branching-off flow paths is not limited to six and may be two or more. The first flow path portion 251*b*, the second flow path portion 252*a*, and the second flow path portion 252*b* have a similar configuration described above.

The first flow path portion 251*a* is a flow path through which ink horizontally flows in a portion between the second flow-path member 220 and the third flow-path member 230. However, the configuration is not limited thereto. In other words, the first flow path portion 251*a* may be a flow path inclined with respect to a Z plane. The first flow path portion 251*b*, the second flow path portion 252*a*, and the second flow path portion 252*b* have a similar configuration.

Furthermore, the first vertical flow path 271*a* is perpendicular to the liquid ejection surface 20*a*. However, the configuration is not limited thereto. In other words, the first vertical flow path 271*a* may be inclined with respect to the liquid ejection surface 20*a*. The first vertical flow path 271*b*, he second vertical flow path 272*a*, and he second vertical flow path 272*b* have a similar configuration.

The COF substrate 98 is provided as a flexible wiring substrate. However, a flexible print substrate (FPC) may be used as the COF substrate 98.

In Embodiment 1, the holding member 120 and the flow-path member 200 are fixed using, for example, an adhesive. However, the holding member 120 and the flow-path member 200 may be integrally formed. In other words, both the hold portion 121 and the leg portion 122 may be provided on the Z1 side of the flow-path member 200. Accordingly, the holding member 120 is not stacked in the Z direction, the Z-direction size of the flow-path member 200 can be reduced. Furthermore, since the hold portion 121 is provided in the flow-path member 200, the size of the flow-path member 200 in both the X direction and in the Y direction can be reduced because it is necessary for the flow-path member 200 to accommodate only a plurality of head main bodies 110 and it is not necessary for the flow-path member 200 to accommodate the relay substrate 140. Furthermore, a plurality of members are integrally formed, and thus the number of parts can be reduced. When the flow-path member 200 is constituted of the first flow-path member 210, the second flow-path member 220, and the third flow-path member 230, both the hold portion 121 and the leg portion 122 may be provided on the Z1 side of the third flow-path member 230.

In Embodiment 1, the head main bodies 110 are aligned in the Y direction and the plurality of head main bodies 110 constitutes the recording head 100. However, the recording head 100 may be constituted of one head main body 110. Furthermore, the number of the recording heads 100 provided in the head unit 101 is not limited. Two or more recording heads 100 may be mounted or one single recording head 100 may be mounted in the ink jet type recording apparatus 1.

The ink jet type recording apparatus 1 described above is a so-called line type recording apparatus in which the head unit 101 is fixed and only the recording sheet S is transported, in such a manner that printing is performed. However, the configuration is not limited thereto. The invention can be applied to a so-called serial type recording apparatus in which the head unit 101 and one or a plurality of recording heads 100 are mounted on a carriage, the head unit 101 or the recording head 100 move in a main scanning direction intersecting the transporting direction of the recording sheet S, and the recording sheet S is transported, in such a manner that printing is performed.

The invention is intended to be applied to a general liquid ejecting head unit. The invention can be applied to a liquid ejecting head unit which includes a recording head of, for example, an ink jet type recording head of various types used for an image recording apparatus, such as a printer, a coloring material ejecting head used to manufacture a color filter for a liquid crystal display or the like, an electrode material ejecting head used to form an electrode for an organic EL display, a field emission display (FED) or the like, or a bio-organic material ejecting head used to manufacture a biochip.

The wiring substrate of the invention is not intended to be applied to only a liquid ejecting head and can be applied to, for example, a certain electronic circuit.

What is claimed is:

1. A liquid ejecting head comprising:

nozzle openings configured to eject liquid in a liquid ejecting direction;

a first piezoelectric layer configured to deform to eject liquid from parts of the nozzle openings;

a first flexible wiring substrate electrically connected to the first piezoelectric layer; and a flow-path member including a first opening portion that penetrates in the liquid ejecting direction and into which the first flexible wiring substrate is inserted;

wherein the flow-path member defines:

a first flow path portion communicating with parts of the nozzle openings;

a second flow path portion communicating with parts of the nozzle openings;

a third flow path portion communicating with parts of the nozzle openings; and a fourth flow path portion communicating with parts of the nozzle openings;

wherein the first, second, third and fourth flow path portions respectively extend in a longitudinal direction of the flow-path member, wherein at least a part of the first flow path portion and at least a part of the second flow path portion are overlapped in the liquid ejecting direction, wherein at least a part of the third flow path portion and at least a part of the fourth flow path portion are overlapped in the liquid ejecting direction, and wherein the first opening portion is located between the second flow path portion and the fourth flow path portion in a direction orthogonal to the longitudinal direction.

2. The liquid ejecting head according to claim 1, further comprising:

a second piezoelectric layer configured to deform to eject liquid from parts of the nozzle openings; and a second flexible wiring substrate electrically connected to the second piezoelectric layer;

wherein a flow-path member includes a second opening portion that penetrates in the liquid ejecting direction and into which the second flexible wiring substrate is inserted, and protrusion portions that protrude in a direction opposite to the liquid ejecting direction, the protrusion portions including:

a first protrusion portion where a flow path communicating with the first flow path portion is formed;

a second protrusion portion where a flow path communicating with the second flow path portion is formed;

a third protrusion portion where a flow path communicating with the third flow path portion is formed; and a fourth protrusion portion where a flow path communicating with the fourth flow path portion is formed;

wherein the first and second protrusion portions are in a first direction orthogonal to a direction in which the first and second opening portions are arranged more than the first and second opening portions when viewed in the liquid ejecting direction, and wherein the third and fourth protrusion portions are in a second direction opposite to the first direction more than the first and second opening portions when viewed in the liquid ejecting direction.

3. The liquid ejecting head according to claim 2, wherein the first and second protrusion portions are arranged in a direction in which the first and second opening portions are arranged, and the third and fourth protrusion portions are arranged in a direction in which the first and second opening portions are arranged.

4. The liquid ejecting head according to claim 3, wherein the first, second, third, and fourth protrusion portions are disposed at ends of the flow-path member in the longitudinal direction.

5. The liquid ejecting head according to claim 4, wherein the first flexible wiring substrate is a COF substrate.

6. The liquid ejecting head according to claim 4, wherein the flow-path member includes a first flow-path member and a second-flow path member that are stacked on each other, the first flow-path member defines the first and third flow path portions, the second flow-path member defines:

the second and fourth flow path portions;

a first vertical flow path that overlaps the second flow path portion when viewed in a direction orthogonal to the longitudinal direction and the liquid ejecting direction, and that communicates with the first flow path portion; and a second vertical flow path that overlaps the fourth flow path portion when viewed in a direction orthogonal to the longitudinal direction and the liquid ejecting direction, and that communicates with the second flow path portion.

7. The liquid ejecting head according to claim 3, wherein the first flexible wiring substrate is a COF substrate.

8. The liquid ejecting head according to claim 3, wherein the flow-path member includes a first flow-path member and a second-flow path member that are stacked on each other, the first flow-path member defines the first and third flow path portions, the second flow-path member defines:

the second and fourth flow path portions;

a first vertical flow path that overlaps the second flow path portion when viewed in a direction orthogonal to the longitudinal direction and the liquid ejecting direction, and that communicates with the first flow path portion; and a second vertical flow path that overlaps the fourth flow path portion when viewed in a direction orthogonal to the longitudinal direction and the liquid ejecting direction, and that communicates with the second flow path portion.

9. A liquid ejecting apparatus comprising the liquid ejecting head according to claim 3.

10. The liquid ejecting head according to claim 2, wherein the first, second, third, and fourth protrusion portions are disposed at ends of the flow-path member in the longitudinal direction.

11. The liquid ejecting head according to claim 10, wherein the first flexible wiring substrate is a COF substrate.

12. The liquid ejecting head according to claim 10, wherein the flow-path member includes a first flow-path member and a second-flow path member that are stacked on each other, the first flow-path member defines the first and third flow path portions, the second flow-path member defines:

the second and fourth flow path portions;

a first vertical flow path that overlaps the second flow path portion when viewed in a direction orthogonal to the longitudinal direction and the liquid ejecting direction, and that communicates with the first flow path portion; and a second vertical flow path that overlaps the fourth flow path portion when viewed in a direction orthogonal to the longitudinal direction and the liquid ejecting direction, and that communicates with the second flow path portion.

13. The liquid ejecting head according to claim 2, wherein the first flexible wiring substrate is a COF substrate.

14. The liquid ejecting head according to claim 2, wherein the flow-path member includes a first flow-path member and a second-flow path member that are stacked on each other, the first flow-path member defines the first and third flow path portions, the second flow-path member defines:

the second and fourth flow path portions;

a first vertical flow path that overlaps the second flow path portion when viewed in a direction orthogonal to the longitudinal direction and the liquid ejecting direction, and that communicates with the first flow path portion; and a second vertical flow path that overlaps the fourth flow path portion when viewed in a direction orthogonal to the longitudinal direction and the liquid ejecting direction, and that communicates with the second flow path portion.

15. A liquid ejecting apparatus comprising the liquid ejecting head according to claim 2.

16. The liquid ejecting head according to claim 1, wherein the first flexible wiring substrate is a COF substrate.

17. The liquid ejecting head according to claim 16, wherein the flow-path member includes a first flow-path member and a second-flow path member that are stacked on each other, the first flow-path member defines the first and third flow path portions, the second flow-path member defines:

the second and fourth flow path portions;

a first vertical flow path that overlaps the second flow path portion when viewed in a direction orthogonal to the longitudinal direction and the liquid ejecting direction, and that communicates with the first flow path portion; and a second vertical flow path that overlaps the fourth flow path portion when viewed in a direction orthogonal to the longitudinal direction and the liquid ejecting direction, and that communicates with the second flow path portion.

18. The liquid ejecting head according to claim 1, wherein the flow-path member includes a first flow-path member and a second-flow path member that are stacked on each other, the first flow-path member defines the first and third flow path portions, the second flow-path member defines:

the second and fourth flow path portions;

a first vertical flow path that overlaps the second flow path portion when viewed in a direction orthogonal to the longitudinal direction and the liquid ejecting direction, and that communicates with the first flow path portion; and a second vertical flow path that overlaps the fourth flow path portion when viewed in a direction orthogonal to the longitudinal direction and the liquid ejecting direction, and that communicates with the second flow path portion.

19. The liquid ejecting head according to claim 1, further comprising a nozzle plate including the nozzle openings, wherein the nozzle plate and the flow-path member formed of stainless steel.

20. A liquid ejecting apparatus comprising the liquid ejecting head according to claim 1.

* * * * *